US006660463B2

(12) United States Patent
Noguchi et al.

(10) Patent No.: US 6,660,463 B2
(45) Date of Patent: Dec. 9, 2003

(54) COLOR LIGHT-SENSITIVE MATERIALS, AS WELL AS AN IMAGE PROCESSING METHOD AND APPARATUS USING THE SAME

(75) Inventors: Takafumi Noguchi, Kanagawa (JP); Junichiro Hosokawa, Kanagawa (JP); Mitsuhiro Uchida, Kanagawa (JP); Yasuhiro Shimada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/243,866

(22) Filed: Sep. 16, 2002

(65) Prior Publication Data

US 2003/0198903 A1 Oct. 23, 2003

(30) Foreign Application Priority Data

Sep. 14, 2001 (JP) ..... 2001-280367

(51) Int. Cl.[7] ..... G03C 1/46
(52) U.S. Cl. ..... 430/503
(58) Field of Search ..... 430/503

(56) References Cited

U.S. PATENT DOCUMENTS 5,298,370 A * 3/1994 Kojima et al. ..... 430/393
6,403,292 B1 * 6/2002 Pawlak et al. ..... 430/434

FOREIGN PATENT DOCUMENTS

| | | |
|---|---|---|
| JP | 06-139323 A | 5/1994 |
| JP | 11-305396 A | 11/1999 |
| JP | 2000-310840 A | 11/2000 |

* cited by examiner

*Primary Examiner*—Hoa Van Le
(74) *Attorney, Agent, or Firm*—Sughrue Mion, PLLC

(57) ABSTRACT

The color light-sensitive material has at least four light-sensitive layers of different spectral sensitivity waveforms in a visible range, with a covariance between spectral sensitivities of at least four light-sensitive layers being no more than 0.5, and at least four light-sensitive layers, after development processing, being colored with color materials having different spectral absorption waveforms. The image processing method and apparatus expose and develop the color light-sensitive material described above to form an image, allow the image formed on the color light-sensitive material to be entered by an image input device having at least four light-sensitive portions of different spectral sensitivity waveforms and perform color transformation with an image converting unit on an input image obtained by entering.

13 Claims, 4 Drawing Sheets

COLOR LIGHT-SENSITIVE MATERIALS, AS WELL AS AN IMAGE PROCESSING METHOD AND APPARATUS USING THE SAME

BACKGROUND OF THE INVENTION

This invention relates to color light-sensitive materials, as well as an image processing method and apparatus using the same. More particularly, the invention relates to color light-sensitive materials capable of faithful color reproduction, as well as an image processing method and apparatus for performing color transformation on images produced with the color light-sensitive materials.

The level of color reproduction that can be accomplished by currently available light-sensitive materials is very high but by no means completely satisfactory. To cope with this situation, two approaches have been attempted.

One approach is by providing a fourth light-sensitive layer (cyan light-sensitive layer) to improve the precision in color reproduction as attempted in REALA, a color light-sensitive material manufactured by the Applicant, Fuji Photo Film Co., Ltd. As disclosed in JP 11-305396 A, REALA has a cyan light-sensitive layer provided as a fourth light-sensitive layer in addition to the ordinary red, green and blue light-sensitive layers, and a DIR compound which releases a development inhibitor during development is contained in order to enhance the interlayer development-inhibiting effects (so-called interimage effects), thereby improving the precision in color reproduction. This approach has successfully attained the intended object, improvement in color reproduction. On the other hand, the limitations from chemical reactions have prevented the fourth light-sensitive layer from exhibiting its performance to the fullest extent.

The other approach is based on introducing the digital image processing technology which has seen marked advances in recent years. A known version of this approach comprises forming images on a color negative film, photoelectrically reading the images with a scanner or the like so that they are converted to electric signals, subjecting the electric signals to image processing to prepare digital image data, and transferring image information to another image recording material using the digital image data. In this method, the information recorded on a taking color film is first converted to digital image data before image reproduction and the image containing the information is not directly projected onto a color paper through optics for preparing a finished color print. As a result, the constraint on film design, or the need to ensure that the blue, green or red color information in the subject corresponds to the yellow, magenta or cyan dye image information, respectively, is not necessarily a factor of paramount importance. This provides room for making a color light-sensitive material of higher capabilities by designing a different structure than the conventional color light-sensitive materials.

For example, JP 6-139323 A describes a color negative film that has a simple structure and which can yet output the image of a subject with faithfully reproduced colors, as well as a digital image processing method and apparatus using the color negative film. With this technology, the film structure can be simplified and an image faithfully reproducing the colors of the subject can be reproduced by digital image processing. However, the precision in color reproduction is inevitably limited by the potentials of the light-sensitive material used.

JP 2000-310840 A describes a light-sensitive material having a luminance layer in addition to the ordinary red, green and blue light-sensitive layers, as well as a method of forming an image from image data obtained by reading the light-sensitive material with a scanner.

However, the luminance layer which is primarily intended to obtain luminance information of high S/N ratio has sensitivity over a broad wavelength range and its spectral sensitivity has an increased overlap with those of other layers. This means that the information from the luminance layer has high correlation with the information from other layers and the addition of the luminance layer has not proved very much effective in improving color reproduction. In short, with the technology under consideration, one can expect an improvement in the reproduction of luminance but not in the reproduction of hues and saturation.

SUMMARY OF THE INVENTION

The present invention has been accomplished under these circumstances and has as an object providing a color light-sensitive material that integrates the two prior art approaches described above, which allows the fourth and ensuing light-sensitive layers to exhibit their performance to the fullest extent without suffering the constraint of chemical reactions and which makes it possible to achieve a color reproduction which is sufficiently improved by increasing the precision in color reproduction without being limited by the potentials of the light-sensitive material used.

Another object of the invention is to provide an image processing method using such improved color light-sensitive material.

A further object of the invention is to provide an image processing apparatus using the color light-sensitive material.

In order to attain the object described above, the first aspect of the present invention provides a color light-sensitive material having at least four light-sensitive layers of different spectral sensitivity waveforms in a visible range, with a covariance between spectral sensitivities of at least four light-sensitive layers being no more than 0.5, and at least four light-sensitive layers, after development processing, being colored with color materials having different spectral absorption waveforms.

Preferably, the spectral absorption waveforms of the color materials have peak wavelengths that differ from one another by at least 20 nm.

Preferably, at least one of the color materials has a spectral absorption maximum at a wavelength longer than 720 nm or shorter than 430 nm.

Preferably, at least four light-sensitive layers include a cyan sensitive layer.

Preferably, the cyan sensitive layer has a spectral sensitivity peak in a wavelength range of 470 nm–550 nm.

Preferably, at least four light-sensitive layers include a red-sensitive layer, a green-sensitive layer and a blue-sensitive layer.

In order to attain the other object described above, the second aspect of the present invention provides an image processing method comprising steps of exposing and developing the color light-sensitive material described above to form an image, allowing the image formed on the color light-sensitive material to be entered by an image input device having at least four light-sensitive portions of different spectral sensitivity waveforms and performing color transformation on an input image obtained by entering.

Preferably, the color transformation is performed on a basis of spectral sensitivity waveforms of the color light-sensitive material.

In order to attain the further object described above, the third aspect of the present invention provides an image processing apparatus comprising an image input device by which an image formed as a result of exposing and developing the color light-sensitive material described above is entered by at least four light-sensitive portions of different spectral sensitivity waveforms and an image converting unit for performing color transformation on an input image obtained by the image input device.

It is preferable that the image processing apparatus further includes a unit for entering spectral sensitivities of the color light-sensitive material and wherein the image converting unit is operated on a basis of spectral sensitivity waveforms of the color light-sensitive material as entered by the spectral sensitivity input unit.

DESCRIPTION OF THE PREFERRED EMBODIMENTS

Figure 1A:
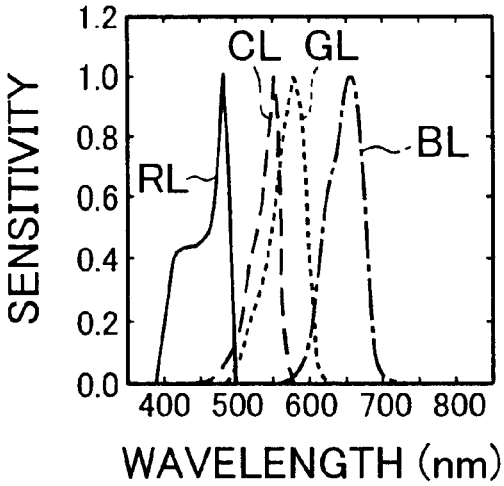
FIG. 1A is a graph showing exemplary spectral sensitivity waveforms for the color light-sensitive material of the invention.

The color light-sensitive material of the invention, as well as the image processing method and apparatus using the same are described below in detail with reference to the preferred embodiments depicted in the accompanying drawings.

To begin with, we describe the color light-sensitive material according to the first aspect of the invention. The color light-sensitive material of the invention has at least four light-sensitive layers of different spectral sensitivity waveforms in the visible range, with the covariance between the spectral sensitivities of the at least four light-sensitive layers being no more than 0.5; in other words, the color light-sensitive material of the invention contains at least four light-sensitive layers each having color sensitivity in the visible range and which have small overlaps between their spectral sensitivities. In addition, the at least four light-sensitive layers, after development processing, form color in different spectral absorption waveforms, namely, form color with color materials having different spectral absorption waveforms.

In the color light-sensitive material of the invention, the spectral absorption waveforms of the color materials have preferably peak wavelengths that differ from one another by at least 20 nm. It is also preferred that at least one of the color materials has a spectral absorption maximum at a wavelength longer than 720 nm or shorter than 430 nm.

On the pages that follow, the color light-sensitive material of the invention is described with reference to a typical example which has a cyan, a red, a green and a blue light-sensitive layers as at least four light-sensitive layers. The present invention, however, is by no means limited to this particular example.

In the color light-sensitive material of the invention, the red light-sensitive layer is preferably a red-sensitive silver halide emulsion layer containing a cyan coupler as a color material to form color. The spectral sensitivity of the red-sensitive layer has preferably a peak at 580 nm and higher, more preferably in the range of 610 nm–650 nm.

The green light-sensitive layer is preferably a green-sensitive silver halide emulsion layer containing a magenta coupler as a color material to form color. The spectral sensitivity of the green-sensitive layer has preferably a peak in the range of 490 nm–580 nm, more preferably 510 nm–565 nm.

The blue-sensitive layer is preferably a blue-sensitive silver halide emulsion layer containing a yellow coupler as a color material to form color.

The red-, green- and blue-sensitive layers may each consist of a single layer or a plurality of sub-layers such as low-sensitivity (red, green or blue) sensitive (emulsion) layer, a medium-sensitivity (red, green or blue) sensitive (emulsion) layer, and a high-sensitivity (red, green or blue) sensitive (emulsion) layer.

The cyan-sensitive layer is the most characterizing part of the color light-sensitive material of the invention and is preferably a cyan-sensitive silver halide emulsion layer containing a color material to form color that has a spectral absorption maximum at a wavelength longer than 720 nm (in the infrared region) or shorter than 430 nm (in the ultraviolet region), as exemplified by an infrared coupler or an ultraviolet coupler. The spectral sensitivity of the cyan-sensitive layer has preferably a peak in the wavelength range of 470 nm–550 nm. The spectral absorption waveform of the color material in the cyan-sensitive layer, if it forms color in the infrared region, must have a peak wavelength longer than 720 nm after development processing; if the color material forms color in the ultraviolet region, the peak wavelength must be shorter than 430 nm.

Needless to say, the cyan-sensitive layer may also consist of a single layer or a plurality of sub-layers.

The red-, green- and blue-sensitive layers as used herein may be of any type as long as the covariance between the spectral sensitivities of four light-sensitive layers including the cyan-sensitive layer is 0.5 or below, preferably 0.3 or below. Examples that can be used are the red-, green- and blue-sensitive layers that are employed in the silver halide light-sensitive material disclosed in commonly assigned JP 11-305396 A as exemplified by REALA, a color light-sensitive material manufactured by the Applicant Fuji Photo Film Co., Ltd.

The cyan-sensitive layer is an entirely novel light-sensitive layer in that it contains a color material that forms color in either the infrared or ultraviolet region. It may have the same spectral sensitivity characteristics (curve) as the cyan-sensitive layer (non-color forming layer) which is employed in the silver halide light-sensitive material disclosed in JP 11-305396 A, supra, as exemplified by the above-mentioned color light-sensitive material REALA.

In the color light-sensitive material of the invention, the spectral sensitivities of the four light-sensitive layers under consideration should have covariances of 0.5 or less for the following reasons.

Consider, first, the color light-sensitive material of the invention which, as shown in FIG. 1A, employs REALA to provide a red-sensitive layer (RL), a green-sensitive layer (GL) and a blue-sensitive layer (BL), plus the spectral sensitivity characteristics of the cyan-sensitive layer (CL) in REALA which is used as the fourth light-sensitive layer. The correlation between the spectral sensitivities of the four light-sensitive layers is as shown in Table 1.

From Table 1, one can see that the spectral sensitivities of the four light-sensitive layers RL, GL, BL and CL in the color light-sensitive material of the invention have a maximum covariance of 0.163, with all covariances being 0.2 or less, hence 0.5 or less.

TABLE 1

Correlation (covariances) between the spectral sensitivities of RL, GL, BL and CL in light-sensitive material

| | RL | GL | BL | CL |
|---|---|---|---|---|
| RL | 1.000 | 0.024 | 0.052 | 0.030 |
| GL | 0.024 | 1.000 | 0.051 | 0.163 |
| BL | 0.052 | 0.051 | 1.000 | 0.020 |
| CL | 0.030 | 0.163 | 0.020 | 1.000 |

Figure 1B:
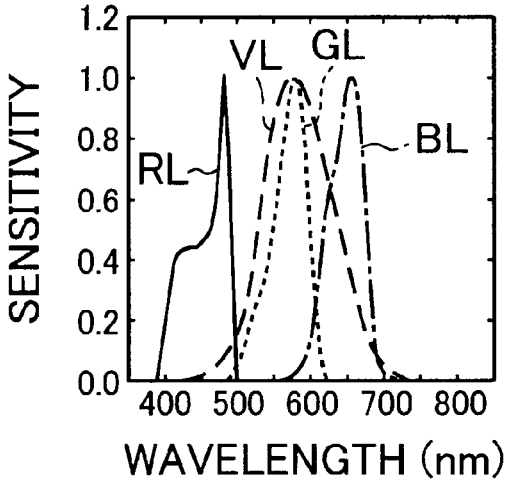
FIG. 1B is a graph showing the spectral sensitivity waveforms of a prior art light-sensitive material.

Consider then a comparative color light-sensitive material which, as shown in FIG. 1B, employs REALA to provide a red-sensitive layer (RL), a green-sensitive layer (GL) and a blue-sensitive layer (BL), plus a spectral luminous efficiency curve as the spectral sensitivity characteristics of the luminance layer (VL) disclosed in JP 2000-310840 A. The correlation between the spectral sensitivities of the four light-sensitive layers is as shown in Table 2.

From Table 2, one can see that the spectral sensitivities of the four light-sensitive layers RL, GL, BL and VL in the comparative color light-sensitive material have a maximum covariance of 0.685 (between GL and VL) which is greater than 0.5.

TABLE 2

Correlation (covariances) between the spectral sensitivities of RL, GL, BL and VL in light-sensitive material

| | RL | GL | BL | VL |
|---|---|---|---|---|
| RL | 1.000 | 0.024 | 0.052 | 0.056 |
| GL | 0.024 | 1.000 | 0.051 | 0.685 |
| BL | 0.052 | 0.051 | 1.000 | 0.096 |
| VL | 0.056 | 0.685 | 0.096 | 1.000 |

Let us use FOM (figure of merit) as an index of evaluating spectral sensitivities in order to compare the color reproducing properties of the two color light-sensitive materials shown in Tables 1 and 2. FOM was first proposed by Sharma-Trussell as a criterion for evaluating spectral sensitivities [IEEE Trans. Image Processing, 6(7), pp. 990–1001 (1997)] and is given by the following equation (1):

$$FOM(e) = \sum_{j=1}^{N} (e, D_j)/(e, e) \tag{1}$$

where e is a given color matching function, $D_j$ (j=a natural number of 1-N) represents the spectral sensitivity characteristics (curve) of a color light-sensitive material as a color image taking medium, and (,) designates the internal product given by the following equation (2):

$$(f, g) = \int_{vis} f(\lambda) \cdot g(\lambda) d\lambda \tag{2}$$

According to Sharma-Trussell, if a color image taking medium (color light-sensitive material) having the spectral sensitivity curve $D_j$ (j=a natural number of 1-N) is used to take a picture of a subject, the differences that the L*, a* and b* values in a uniform color space CIE L*a*b* of the subject in the picture are likely to have from the L*, a* and b* values for the actual subject, namely, the expected values of the differences ΔL*, Δa* and Δb* which are written as E[ΔL*], E[Δa*] and E[Δb*], can be related to FOM by the following expressions (3) to (5):

$$E[\Delta L^*] \propto (FOM(y))^{-1} \tag{3}$$

$$E(\Delta a^*) \propto (FOM(x\text{-}y))^{-1} \tag{4}$$

$$E(\Delta b^*) \propto (FOM(y\text{-}z))^{-1} \tag{5}$$

Since the expected value E[ΔL*] is in inverse proportion to FOM(y) where y is the color matching function y(λ), the larger the FOM(y), the smaller the expected value E[ΔL*] is and the smaller the difference between the L* value of the subject in the picture and the L* value of the actual subject is likely to be. Similarly, the larger the FOM(x-y), the smaller the expected value E[Δa*] is and the smaller the difference between the a* value of the subject in the picture and the a* value of the actual subject is likely to be. In addition, the larger the FOM(y-z), the smaller the expected value E[Δb*] is and the smaller the difference between the b* value of the subject in the picture and the b* value of the actual subject is likely to be. Therefore, the larger the values of FOM(y), FOM(x-y) and FOM(y-z), the more appropriate will be the manner in which the colors of the actual subject are reproduced in a picture.

Table 3 shows the result of FOM based comparison of color reproduction between the two color light-sensitive materials described in Tables 1 and 2. The color light-sensitive material indicated in the top row of Table 3 which has three light-sensitive layers RL, GL and BL is a conventional product and was prepared as comparative sample 102 in Example 1 to be described below. The color light-sensitive material indicated in the bottom row of Table 3 is the same as what is shown in Table 1 and was prepared as invention sample 101 in Example 1. Details of samples 101 and 102 will be given later in this specification.

TABLE 3

Comparison of color reproduction in three samples of light-sensitive material

| | FOM (y) | FOM (x–y) | FOM (y–z) |
|---|---|---|---|
| (1) RL, GL, BL | 0.88 | 0.77 | 0.80 |
| (2) RL, GL, BL, VL | 1.00 | 0.78 | 0.83 |
| (3) RL, GL, BL, CL | 0.90 | 0.92 | 0.80 |

From Table 3, one can see that the addition of VL caused a marked increase in FOM(y), hence, achieved appreciable improvement in lulminance reproduction compared to the conventional color light-sensitive material using only three light-sensitive layers. On the other hand, the addition of VL was little effective in improving the reproduction of hues and saturation since the values of FOM (x-y) and FOM(y-z) did not change.

The addition of CL was not effective in improving luminance reproduction over the conventional color light-sensitive material; on the other hand, it caused a marked increase in FOM(x-y), showing an outstanding improvement in the reproduction of red to green color.

Therefore, in the color light-sensitive material of the invention, the spectral sensitivities of the four light-sensitive layers are specified to have covariances of 0.5 or less, preferably 0.3 or less.

The red-, green-, blue- and cyan-sensitive layers in the color light-sensitive material of the invention are preferably such that the spectral absorption waveforms of the color materials used have peaks at wavelengths that differ from one another by at least 20 nm.

The reason is this: a densitometer or commercially available image inputting means such as a scanner have no smaller half peak width for spectral sensitivity than about 20 nm, so in order to separate the information in one layer from the information in another with high precision, it is desirable that the spectral absorption waveforms of the color materials used have peaks at wavelengths that are spaced apart by at least 20 nm.

As described above, the cyan-sensitive layer in the color light-sensitive material of the invention preferably contains either an infrared coupler which is a color material to form color having a spectral absorption maximum at a wavelength longer than 720 nm (in the infrared region) or an ultraviolet coupler which is a color material to form color having a spectral absorption maximum at a wavelength shorter than 430 nm (in the ultraviolet region).

The infrared coupler, or a coupler that reacts with the oxidation product of a developing agent to form a dye having infrared absorption, may be represented by the following general formula (I):

General formula (I)

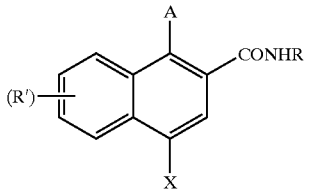

where A is a substituent having a dissociative group; R is an alkyl, aryl or heterocyclic group; R' is a substituent; X is a hydrogen atom or a group that can leave upon coupling reaction with the oxidation product of a developing agent; 1 is an integer of 0–4.

The infrared coupler of the general formula (I) is described below in detail.

In the general formula (I), A represents a substituent having a dissociative group, preferably a dissociative substituent having an acid dissociation constant of 6–14, more preferably a dissociative substituent having an acid dissociation constant of 8–12.

Specifically, A may be exemplified by a hydroxyl group, a sulfonamido group (methanesulfonamido, benzenesulfonamido), a dicyanomethylene group and a cyanoamino group.

R represents an alkyl group, an aryl group or a heterocyclic group, each of which may be substituted. Exemplary substituents include those listed below as examples of the substituent R'. The alkyl group is a substituted or unsubstituted alkyl group having 1–30 carbon atoms and may be exemplified by methyl, octyl, dodecyl and 2,5-di-t-amylphenoxypropyl.

The aryl group is a substituted or unsubstituted aryl group having 6–60 carbon atoms and may be exemplified by phenyl, p-tolyl and naphthyl. If R is a substituted aryl group, exemplary substituents include those listed below as examples of the substituent R' and preferred are electron attracting groups with a Hammett σ constant of at least 0.2, as exemplified by a halogen atom, a sulfamoyl group, a sulfonyl group, an alkoxycarbonyl group, a carbamoyl group and a cyano group.

The heterocyclic group is preferably such that ring forming hetero atoms are selected from among a nitrogen atom, an oxygen atom and a sulfur atom, with carbon atoms being also included as ring forming atoms in addition to the hetero atoms; the heterocyclic group is preferably 3–8 membered, more preferably 5–6 membered, and may be exemplified by thiazolyl, triazolyl, imidazolyl, pyrazolyl, thiadiazolyl, oxazolyl, oxadiazolyl and tetrazolyl, which may be optionally fused together.

Represented by R' is a substituent which may be exemplified by a halogen atom (e.g. chlorine atom, bromine atom, fluorine atom), an alkyl group (with 1–60 carbon atoms, as exemplified by methyl, ethyl, propyl, iso-butyl, t-butyl, t-octyl, 1-ethylhexyl, nonyl, cyclohexyl, undecyl, pentadecyl, n-hexadecyl, 3-decaneamidopropyl), an alkenyl group (with 2–60 carbon atoms, as exemplified by vinyl, allyl, oleyl), a cycloalkyl group (with 5–60 carbon atoms, as exemplified by cyclopentyl, cyclohexyl, 4-t-butylcyclohexyl, 1-indanyl, cyclododecyl), an aryl group (with 6–60 carbon atoms, as exemplified by phenyl, p-tolyl, naphthyl), an acylamino group (with 2–60 carbon atoms, as exemplified by acetylamino, n-butaneamido, octanoylamino, 2-hexyldecaneamido, 2-(2',4'-di-t-amylphenoxy)butaneamido, benzoylamino, nicotinamido), a sulfonamido group (with 1–60 carbon atoms, as exemplified by methanesulfonamido, octanesulfonamido, benzenesulfonamido), a ureido group (with 2–60 carbon atoms, as exemplified by decylaminocarbonylamino, di-n-octylaminocarbonylamino), a urethane group (with 2–60 carbon atoms, as exemplified by dodecyloxycarbonylamino, phenoxycarbonylamino, 2-ethylhexyloxycarbonylamino), an alkoxy group (with 1–60 carbon atoms, as exemplified by methoxy, ethoxy, butoxy, n-octyloxy, hexadecyloxy, methoxyethoxy), an aryloxy group (with 6–60 carbon atoms, as exemplified by phenoxy, 2,4-di-t-amylphenoxy, 4-t-octylphenoxy, naphthoxy), an alkylthio group (with 1–60 carbon atoms, as exemplified by methylthio, ethylthio, butylthio, hexadecylthio), an arylthio group (with 6–60 carbon atoms, as exemplified by phenylthio, 4-dodecyloxyphenylthio), an acyl group (with 1–60 carbon atoms, as exemplified by acetyl, benzoyl, butanoyl, dodecanoyl), a sulfonyl group (with 1–60 carbon atoms, as exemplified by methanesulfonyl, butanesulfonyl, toluenesulfonyl), a cyano group, a carbamoyl group (with 1–60 carbon atoms, as exemplified by N,N-dicyclohexylcarbamoyl), a sulfamoyl group (with 0–60 carbon atoms, as exemplified by N,N-dimethylsulfamoyl), a hydroxyl group, a sulfo group, a carboxyl group, a nitro group, an alkylamino group (with 1–60 carbon atoms, as exemplified by methylamino, diethylamino, octylamino, octadecylamino), an arylamino group (with 6–60 carbon atoms, as exemplified by phenylamino, naphthylamino, N-methyl-N-phenylamino), and an acyloxy group (with 1–60 carbon atoms, as exemplified by formyloxy, acetyloxy, myristoyloxy, benzoyloxy).

Among the groups mentioned above, the alkyl group, cycloalkyl group, aryl group, acylamino group, ureido group, urethane group, alkoxy group, aryloxy group, alkylthio group, arylthio group, acyl group, sulfonyl group, cyano group, carbamoyl group and the sulfamoyl group may be substituted and exemplary substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group.

Represented by X is a hydrogen atom or a group that leaves upon reaction with the oxidation product of a developing agent; examples of such a group include a halogen atom (e.g. fluorine, chlorine, bromine), an alkoxy group (e.g. ethoxy, methoxycarbonylmethoxy, carboxypropyloxy, methanesulfonylethoxy, perfluoropropoxy), an aryloxy group (e.g. 4-carboxyphenoxy, 4-(4-hydroxyphenylsulfonyl)phenoxy, 4-methanesulfonyl-3-carboxyphenoxy, 2-methanesulfonyl-4-acetylsulfamoylphenoxy), an acyloxy group (e.g. acetoxy, benzoyloxy), a sulfonyloxy group (e.g. methanesulfonyloxy, benzenesulfonyloxy), an acylamino group (e.g. heptafluorobutyrylamino), a sulfonamido group (e.g. methanesulfonamido), an alkoxycarbonyloxy group (e.g. ethoxycarbonyloxy), a carbamoyloxy group (e.g. diethylcarbamoyloxy, piperidinocarbonyloxy, morpholinocarbonyloxy, diallylcarbamoyloxy, bisdicyanoethylcarbamoyloxy), an alkylthio group (e.g. 2-carboxyethylthio), an arylthio group (e.g. 2-octyloxy-5-t-octylphenylthio, 2-(2,4-di-t-amylphenoxy)butyrylaminophenylthio), a heterocyclic thio group (e.g. 1-phenyltetrazolylthio, 2-benzimidazolylthio), a heterocyclic oxy group (e.g. 2-pyridyloxy, 5-nitro-2-pyridyloxy), a 5- or 6-membered nitrogenous heterocyclic group (e.g. 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dion-3-yl, purine), and an azo group (e.g. 4-methoxyphenylazo, 4-pivaloylaminophenylazo).

In the general formula (I), X may optionally be substituted and preferred substituents are a halogen atom, an alkoxy group, an aryloxy group, an alkoxycarbonyloxy group, a carbamoyloxy group, an alkylthio or arylthio group, and a 5- or 6-membered nitrogenous heterocyclic group that binds to the coupling activity via a nitrogen atom.

The following are non-limiting specific examples of couplers that may preferably be used in the invention.

(1)

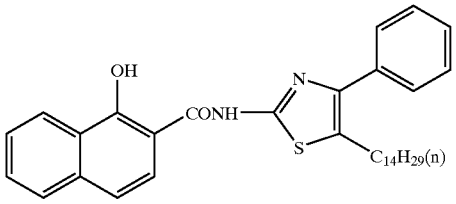

(2)

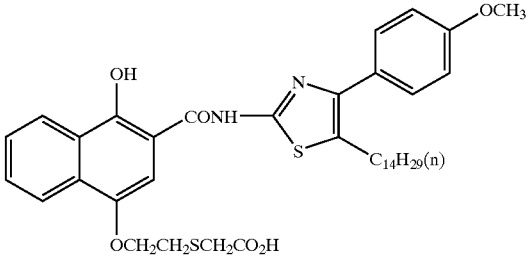

(3)

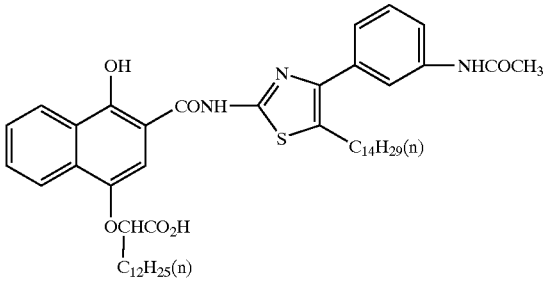

(4)

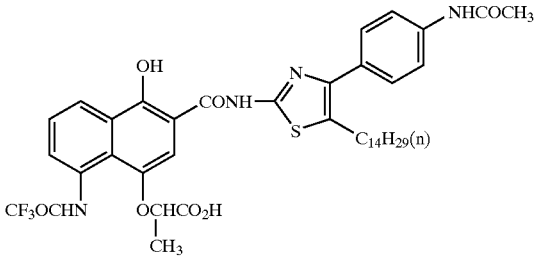

(5)

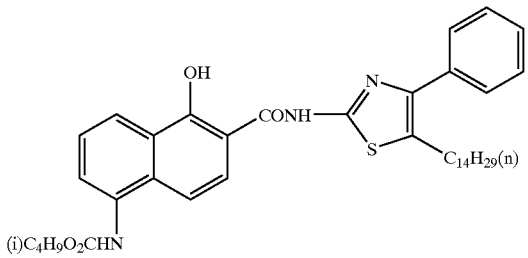

(6)

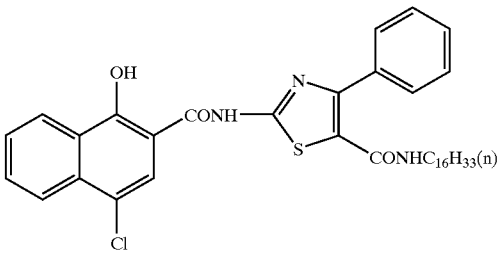

-continued
(7)
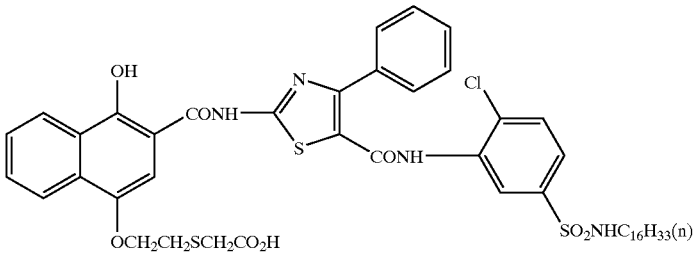
(8)
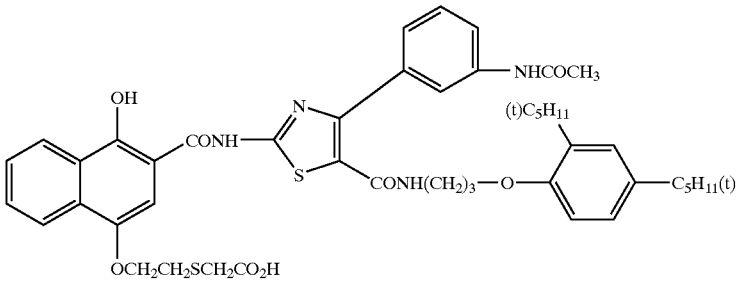
(9)
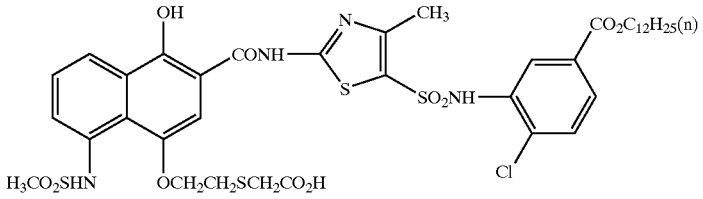
(10)
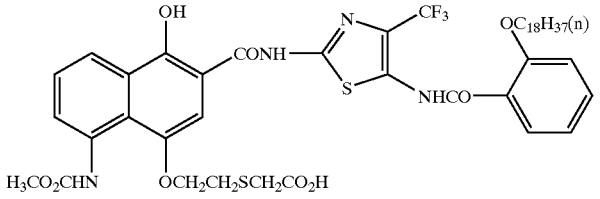
(11)
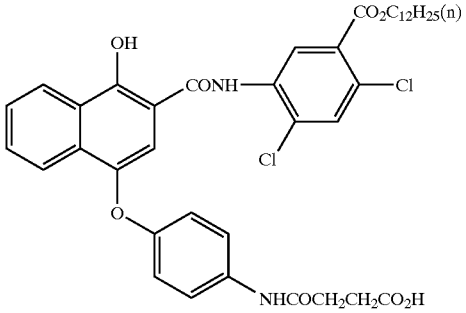
(12)
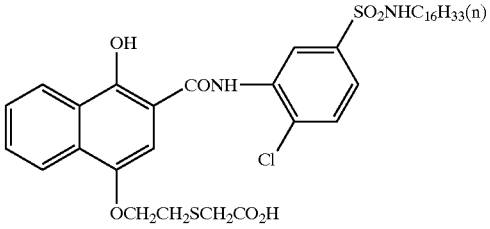
(13)
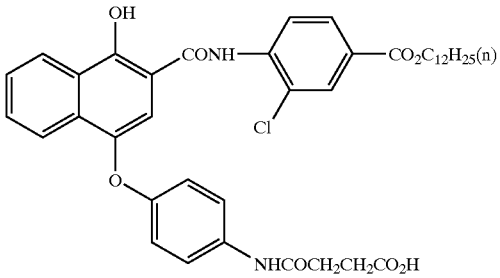
(14)
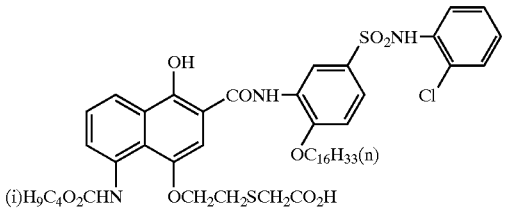

-continued
(15)
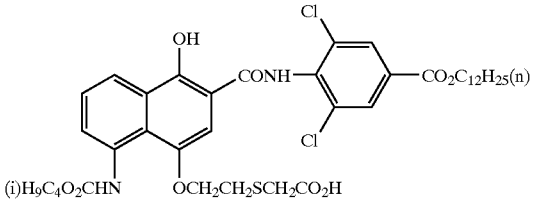
(16)
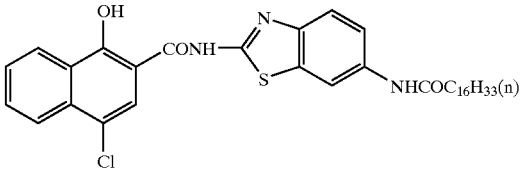
(17)
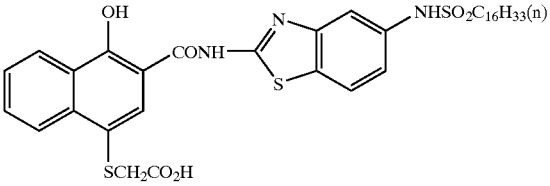
(18)
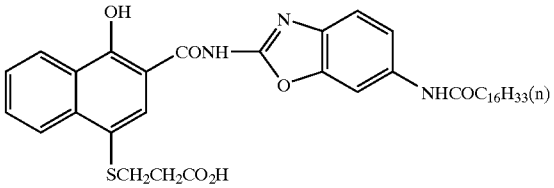
(19)
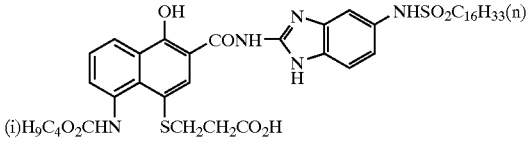
(20)
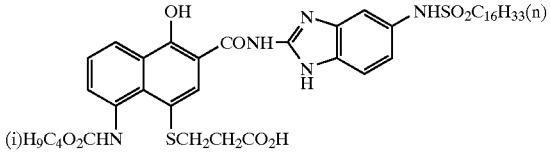
(21)
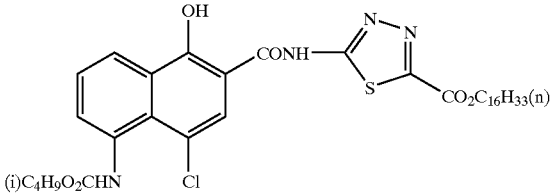
(22)
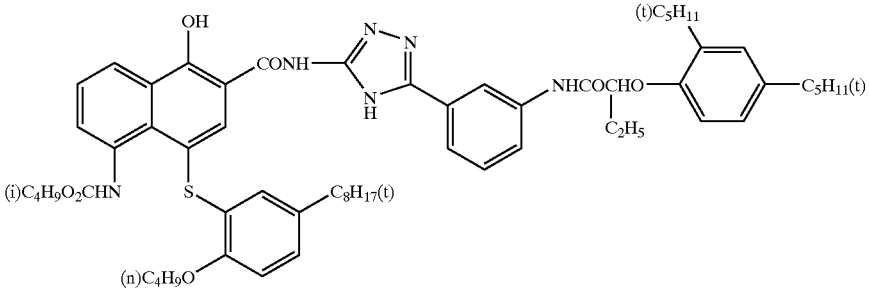
(23)
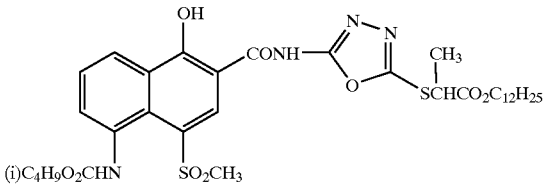
(24)
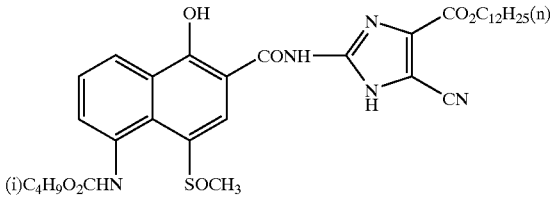

-continued
(25)
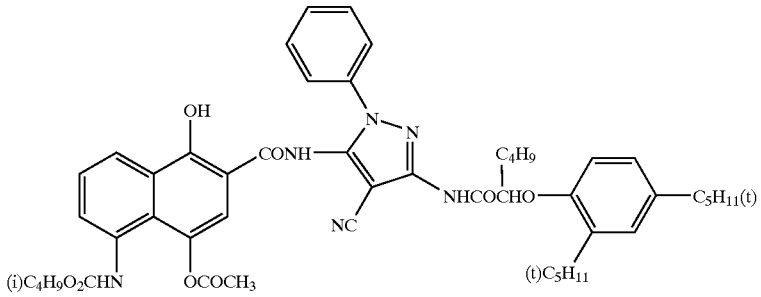
(26)
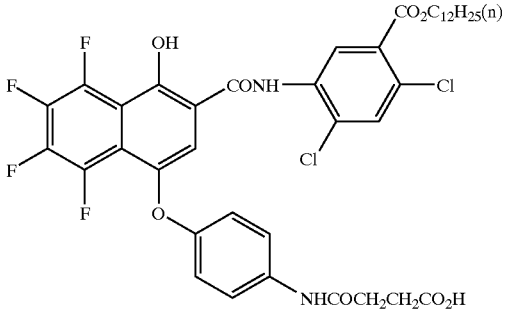
(27)
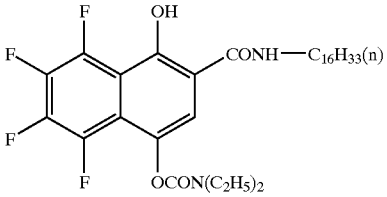
(28)
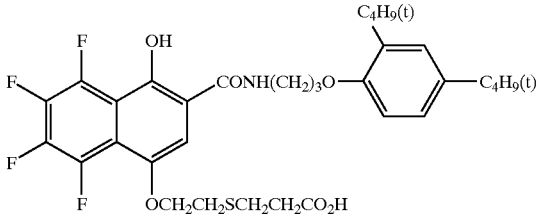
(29)
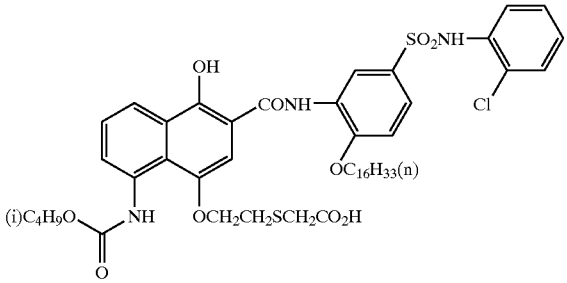
(30)
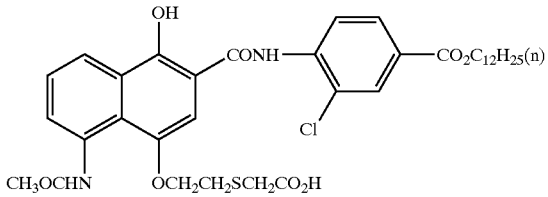
(31)
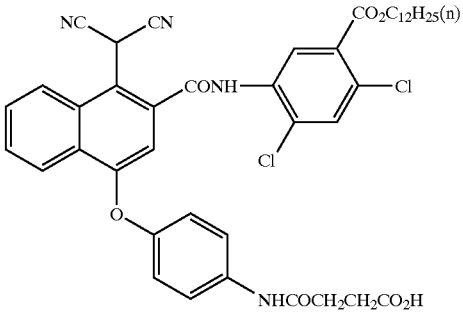
(32)
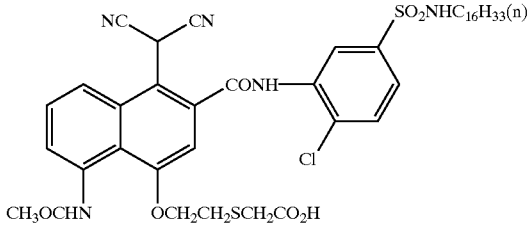
(33)
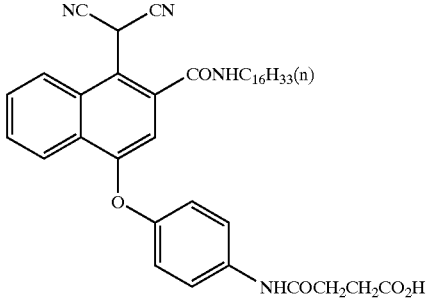

-continued (34)

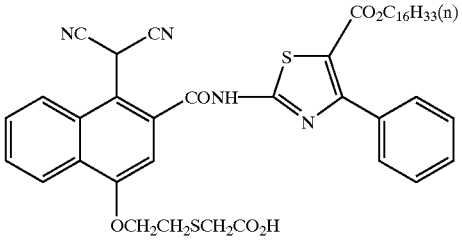

(35)

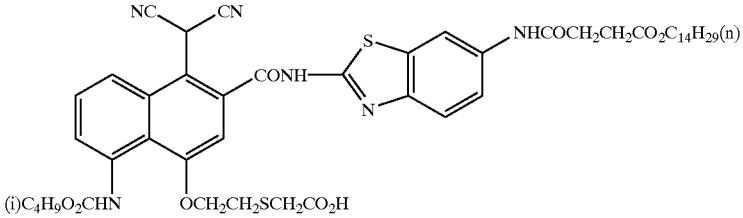

(36)

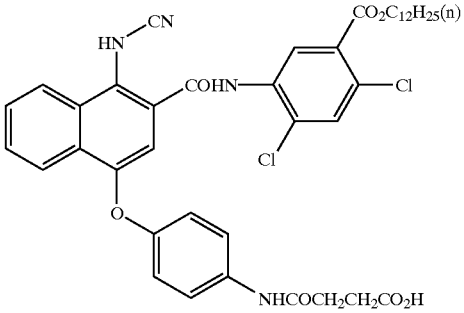

(37)

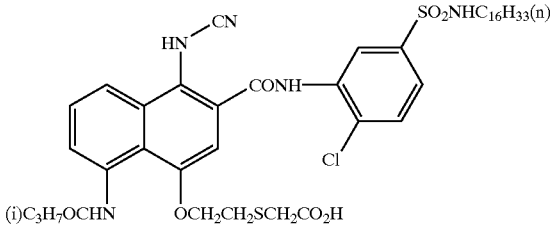

(38)

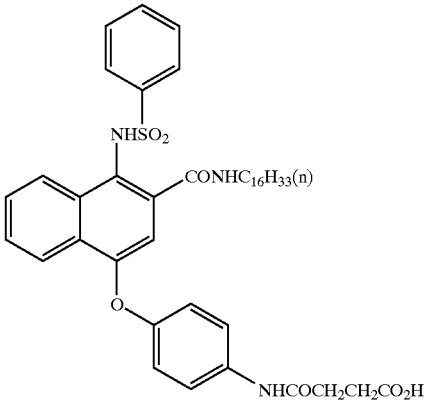

(39)

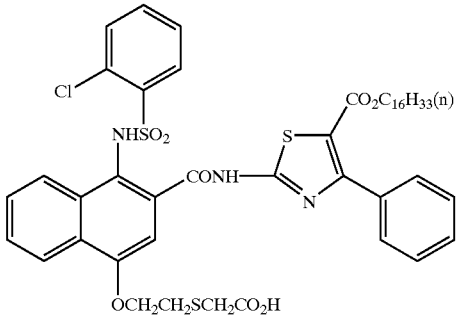

(40)

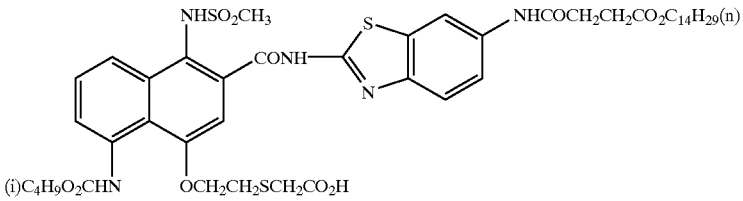

The color light-sensitive material of the invention may comprise a base on which are provided not only the above-described cyan-sensitive layer but also at least three additional light-sensitive layers, a red-, a green- and a blue-sensitive layer. A typical example is a silver halide photographic material comprising a base on which is provided at least one light-sensitive layer consisting of a plurality of silver halide emulsion layers that have sensitivity to substantially the same color but by different degrees. The light-sensitive layer is a unit layer having sensitivity to either blue, green or red light. In multi-layer silver halide color photographic materials, unit light-sensitive layers are usually arranged in the order of a red-, a green- and a blue-sensitive layer, with the red-sensitive layer being the closest to the base. Depending on a specific object, the order of unit light-sensitive layers may be reversed or, alternatively, two layers sensitive to one color may be spaced apart by a layer sensitive to a different color. A non-light-sensitive may be provided between two of the aforementioned silver halide emulsion layers and on both the topmost and bottommost layers. The layers described above may contain the aforementioned couplers, as well as couplers, DIR compounds, anti-color mixing agents, etc. to be described later in this specification.

The silver halide emulsion layers that make up each unit light-sensitive layer are preferably arranged as taught in DE 1,121,470 or GB 9,230,452, i.e., two emulsion layers, one having high sensitivity and the other having low sensitivity, are arranged such that the degree of sensitivity decreases progressively toward the base. Alternatively, as described in JP 57-112751 A, JP 62-200350 A, JP 62-206541 A and JP 62-206543 A, a low-sensitivity emulsion layer may be provided away from the base and a high-sensitivity emulsion layer closer to the base.

A specific arrangement comprises, in order from the side which is the farthest from the base, a blue-sensitive layer of low sensitivity (BL)/a blue-sensitive layer of high sensitivity (BH)/a green-sensitive layer of high sensitivity (GH)/a green-sensitive layer of low sensitivity (GL)/a red-sensitive layer of high sensitivity (RH)/a red-sensitive layer of low sensitivity (RL), or BH/BL/GL/GH/RH/RL, or BH/BL/GH/GL/RL/RH.

Another possible arrangement is described in JP 55-34932 B and comprises, in order from the side which is the farthest from the base, a blue-sensitive layer/GH/RH/GL/RL. If desired, the arrangement described in JP 56-25738 A and JP 62-63936 A may be adopted, which comprises a blue-sensitive layer/GL/RL/GH/RH in order from the side the farthest from the base.

Still another possible arrangement is described in JP 49-15495 B and comprises three layers that vary in the degree of light sensitivity and which are arranged to have it decreased progressively toward the base, namely, a silver halide emulsion layer of the highest sensitivity on the top, a silver halide emulsion layer of the next highest sensitivity in the middle, and a silver halide emulsion layer of even lower sensitivity in the bottom. In this case-, too, where three layers with varying degree of light sensitivity are used, an assembly which comprises, in order from the side the farthest from the base, a medium-sensitivity emulsion layer, a high-sensitivity emulsion layer and a low-sensitivity emulsion layer may be provided in a unit having sensitivity to the same color, as described in JP 59-202464 A.

Other possible arrangements include the combination of a high-sensitivity emulsion layer/a low-sensitivity emulsion layer/a medium-sensitivity emulsion layer and that of a low-sensitivity emulsion layer/a medium-sensitivity emulsion layer/a high-sensitivity emulsion layer. If four or more layers are to be used, various modifications of arrangement may be adopted as mentioned above.

U.S. Pat. Nos. 4,663,271, 4,705,744 and 4,707,436, as well as JP 62-160448 A and JP 63-89850 A describe donor layers (CL) having interimage effects with different spectral sensitivity distributions than principal light-sensitive layers such as BL, GL and RL and, in order to provide better color reproduction, they are preferably provided adjacent to or in close proximity with the principal light-sensitive layers.

Silver halides preferably used in the invention are silver iodobromide, silver iodochloride and silver iodochlorobromide that contain up to about 30 mol % of silver iodide. Particularly preferred are silver iodobromide and silver iodochlorobromide that contain from about 2 mol % up to about 10 mol % of silver iodide.

Silver halide grains in photographic emulsions may have regular such as cubic, octahedral or tetradecahedral crystals, anomalous such as spherical or tabular crystal forms, crystal defects such as twin planes, or composite forms thereof.

The silver halide grains may be fine grains no larger than about 0.2 $\mu$m or large grains with the diameter of a projected area being up to about 10 $\mu$m. The silver halide grains may form a polydisperse or a monodisperse emulsion.

Silver halide photographic emulsions that can be used in the invention may be prepared by using known methods such as those described in Research Disclosure (hereunder abbreviated as RD) No. 17643 (December 1978), pp. 22–23, "I. Emulsion preparation and types", RD No. 18716 (November 1979), p. 648, and RD No. 307105 (November 1989), pp. 863–865, as well as P. Glafkides, Chimie et Phisique Photographiques, Paul Montel 1967, G. F. Duffin, Photographic Emulsion Chemistry, Focal Press, 1966, and V. L. Zelikman et al., Making and Coating Photographic Emulsion, Focal Press, 1964.

Also preferred are the monodisperse emulsions described in U.S. Pat. Nos. 3,574,628 and 3,655,394, and GB Patent No. 1,413,748.

Tabular grains with aspect ratios of about 3 or more may also be used in the invention. Tabular grains can easily be prepared by the methods described in Gutoff, Photographic Science and Engineering, Vol. 14, pp. 248–257 (1970), as well as U.S. Pat. Nos. 4,434,226, 4,414,310, 4,433,048 and 4,439,520 and GB Patent No. 2,112,157.

The structure of crystals may be homogeneous or they may have different halogen compositions in the surface and the interior. Alternatively, they may have a layered structure. Silver halides of different compositions may be joined by epitaxial junction or junction may be made with non-silver halide compounds such as silver rhodanide and lead oxide. If desired, mixtures of grains in various crystal forms may be used.

The emulsions described above may be of a surface sensitive type which forms a latent image primarily in the surface or an internal latent image type which forms a latent image in the interior or of a type that has a latent image in both the surface and the interior; whichever type is used, the emulsions must be negative working. Internal latent image forming emulsions may be of the core/shell type which is described in JP 63-264740 A and emulsions of this type can be prepared by the method described in JP 59-133542 A. The thickness of the shell varies with development processing and the like; it is preferably in the range of 3–40 nm, more preferably in the range of 5–20 nm.

Silver halide emulsions are generally used after physical ripening, chemical ripening and spectral sensitization. Additives to be used in those steps are described in RD Nos. 17643, 18716 and 307105 and relevant portions are listed in the table that follows.

In the light-sensitive materials of the invention, two or more light-sensitive silver halide emulsions that differ in at least one characteristic selected from among grain size, size distribution, halogen composition, grain shape and sensitivity may be used in admixture within the same layer.

The silver halide grains with a fogged surface that are described in U.S. Pat. No. 4,082,553, the silver halide grains with a fogged interior that are described in U.S. Pat. No. 4,626,598 and JP 59-214852 A, or colloidal silver are preferably applied to light-sensitive silver halide emulsion layers and/or substantially non-light-sensitive hydrophilic colloidal layers. Silver halide grains with a fogged interior or surface are those silver halide grains which enable uniform (non-imagewise) development of the light-sensitive material including the unexposed and exposed areas; the methods for preparing such silver halide grains are described in U.S. Pat. No. 4,626,498 and JP 59-214852 A. Silver halide that forms the internal core of internally fogged core/shell type silver halide grains may have different halogen compositions. Silver halide grains with a fogged interior or surface may have any halogen composition selected from silver chloride, silver chlorobromide, silver iodobromide and silver chloroiodobromide. The fogged silver halide grains have preferably a mean particle size of 0.01–0.75 μm, with the range of 0.05–0.6 μm being particularly preferred. The grains may have regular shapes or form polydisperse emulsions but they are preferably monodisperse (i.e. at least 95% of the weight or number of silver halide grains have particle sizes within ±40% of the mean size).

The invention preferably uses non-light-sensitive, fine particulate silver halides. Non-light-sensitive, fine particulate silver halides are fine silver halide grains that are insensitive to imagewise exposing light for producing dye images and which are substantially protected from being developed during development processing; preferably, the non-light-sensitive, fine particulate silver halides are not fogged preliminarily. The fine particulate silver halide contains 0–100 mol % of silver bromide and may optionally contain silver chloride and/or silver iodide as required. Preferably, the fine particulate silver halide contains 0.5–10 mol % of silver iodide. The mean grain size of the fine particulate silver halide (i.e., the mean of the diameter of an equivalent circle of the projected area) is preferably 0.01–0.5 μm, more preferably 0.02–0.2 μm.

The fine particulate silver halide can be prepared by the same method as the ordinary light-sensitive silver halides. The surfaces of silver halide grains need not be optically sensitized nor is it necessary to sensitize them spectrally. Note that prior to adding silver halide grains to a coating solution, known stabilizers such as triazole-, azaindene-, benzothiazolium- or mercapto-based compounds or zinc compounds are preferably added. Colloidal silver may be contained in the layer containing the fine particulate silver halide grains.

The amount of silver to be coated on the light-sensitive material of the invention is preferably no more than 6.0 $g/m^2$, most preferably 4.5 $g/m^2$ or less.

Photographic additives that can be used in the invention are also described in RD and relevant portions are shown in the following table.

| Type of additive | RD 17643 | RD 18716 | RD 307105 |
|---|---|---|---|
| 1. Chemical sensitizer | p. 23 | p. 648, right col. | p. 866 |
| 2. Sensitivity enhancer | | p. 648, right col. | |
| 3. Spectral sensitizer, Supersensitizer | pp. 23–24 | p. 648, right col. to p. 649, right col. | pp. 866–868 |
| 4. Brightener | p. 24 | p. 647, right col. | p. 868 |
| 5. Light absorber, Filter dye, UV absorber | pp. 25–26 | p. 649, right col. to p. 650, left col. | p. 873 |
| 6. Binder | p. 26 | p. 651, left col. | pp. 873–874 |
| 7. Plasticizer, Lubricant | p. 27 | p. 650, right col. | p. 876 |

-continued

| Type of additive | RD 17643 | RD 18716 | RD 307105 |
|---|---|---|---|
| 8. Coating aid, Surfactant | pp. 26–27 | p. 650, right col. | pp. 875–876 |
| 9. Antistatic | p. 27 | p. 650, right col. | pp. 876–877 |
| 10 Matting agent | | | pp. 878–879 |

While various dye forming couplers may be used in the light-sensitive materials of the invention, the following couplers are particularly preferred.

Yellow couplers: couplers represented by formulae (I) and (II) in EP 502,424A; couplers represented by formulae (1) and (2) in EP 513,496A (in particular Y-28 on page 18); couplers represented by formula (I) in claim 1 of EP 568,037A; couplers represented by general formula (1) at lines 45–55 in column 1 of U.S. Pat. No. 5,066,576; couplers represented by general formula (I) in paragraph 0008 of JP 4-274425 A; couplers set forth in claim 1 on page 40 of EP 498,381A1 (in particular, D-35 on page 18); couplers represented by formula (Y) on page 4 of EP 447,969A1 (in particular, Y-1 on page 17 and Y-54 on page 41); couplers represented by formulae (II)–(IV) at lines 36–58 in column 7 of U.S. Pat. No. 4,476,219 (in particular, II-17 and II-19 in column 17 and II-24 in column 19). Magenta couplers: See JP 3-39737 A (L-57 in the lower right part of page 11, L-68 in the lower right part of page 12, L-77 in the lower right part of page 13); EP 456,257 (A-4-63 on page 134, A-4-73 and A-4-75 on page 139); EP 486,965 (M-4 and M-6 on page 26 and M-7 on page 27); EP 571,959A (M-45 on page 19); JP 5-204106 A ((M-1) on page 6); JP 4-362631 A (M-22 in paragraph 0237).

Cyan couplers: CX-1, 3, 4, 5, 11, 12, 14 and 15 in JP 4-204843 A (on pages 14–16); C-7 and C-10 in JP 4-43345 A (on page 35), C-34 and C-35 (on page 37), as well as (I-1) and (I-17) (on pages 42–43); couplers represented by general formula (Ia) or (Ib) in claim 1 of JP 6-67385 A. Polymer couplers: P-1 and P-5 in JP 2-44345 A (on page 11).

Preferred examples of couplers that form color forming dyes with a suitable degree of diffusibility are described in U.S. Pat. No. 4,366,237, GB 2,125,570, EP 96,873B and DE 3,234,533.

Preferred examples of couplers used to correct unwanted absorption by color forming dyes are yellow colored cyan couplers represented by formulae (CI), (CII), (CIII) and (CIV) in EP 456,257A1 on page 5 (in particular, YC-86 on page 84), yellow colored magenta couplers described in the same EP and designated ExM-7 (page 202), EX-1 (page 249) and EX-7 (page 251), magenta colored cyan couplers described in U.S. Pat. No. 4,833,069 and designated CC-9 (column 8) and CC-13 (column 10), (2) in U.S. Pat. No. 4,837,136 (column 8), and colorless masking couplers represented by formula (A) in claim 1 of WO92/11575 (in particular, the compounds exemplified on pages 36–45).

Couplers that release photographically useful groups include the following. Development inhibitor releasing compounds: compounds represented by formulae (I), (II), (III) and (IV) in EP 378,236A1 on page 11 (in particular T-101 on page 30, T-104 on page 31, T-113 on page 36, T-131 on page 45, T-144 on page 51 and T-158 on page 58), compounds represented by formula (I) in EP 436,938A2 on page 7 (in particular, D-49 on page 51), compounds represented by formula (1) in EF 568,037A (in particular, (23) on page 11) and compounds represented by formulae (I), (II) and (III) in EP 440,195A2 on pages 5–6 (in particular, I-(1) on page 29); bleach accelerator releasing compounds: compounds represented by formulae (I) and (I') in EP 310,125A2 on page 5

(in particular, (60) and (61) on page 61) and compounds represented by formula (I) in claim 1 of JP 6-59411 A (in particular, (7) on page 7); ligand releasing compounds: compounds represented by LIG-X in claim 1 of U.S. Pat. No. 4,555,478 (in particular, compounds listed in column 12 at lines 21–41); leuco dye releasing compounds: compounds 1–6 in U.S. Pat. No. 4,749,641 at columns 3–8; fluorescent dye releasing compounds: compounds represented by COUP-DYE in claim 1 of U.S. Pat. No. 4,774,181 (in particular, compounds 1–11 in columns 7–10); development accelerator or foggant releasing compounds: compounds represented by formulae (1), (2) and (3) in U.S. Pat. No. 4,656,123 under column 3 (in particular, (I-22) in column 25) and ExZK-2 in EP 450,637A2 on page 75 at lines 36–38; and compounds that release groups which become dyes only when they leave the compounds: compounds represented by formula (I) in claim 1 of U.S. Pat. No. 4,857,447 (in particular, Y-1 to Y-19 in columns 25–36).

Additives other than couplers may also be incorporated and the following are preferred.

Dispersion mediums for oil-soluble organic compounds: P-3, 5, 16, 19, 25, 30, 42, 49, 54, 55, 66, 81, 85, 86 and 93 in JP 62-215272 A (pages 140–144); latices for impregnating oil-soluble organic compounds: latices described in U.S. Pat. No. 4,199,363; scavengers for the oxidation products of developing agents: compounds represented by formula (I) in U.S. Pat. No. 4,978,606 at column 2 on lines 54–62 (in particular, I-(1), (2), (6) and (12) at columns 4–5) and compounds of the formula at column 2 on lines 5–10 of U.S. Pat. No. 4,923,787 (in particular, compound 1 at column 3); anti-stain agents: compounds of formulae (I)–(III) in EP 298321A on page 4 at lines 30–33, in particular, I-47 and 72 as well as III-1 and 27 on pages 24–48; anti-fading agents: A-6, 7, 20, 21, 23, 24, 25, 26, 30, 37, 40, 42, 48, 63, 90, 92, 94 and 164 in EP 298321A on pages 69–118, II-1 to III-23, in particular, III-10 in U.S. Pat. No. 5,122,444 at columns 25–38, I-1 to III-4, in particular, II-2 in EP 471347A on pages 8–12, and A-1 to A-48, in particular, A-39 and A-42 in U.S. Pat. No. 5,139,931 at columns 32–40; materials that help reduce the use of color intensifiers or anti-color mixing agents: I-1 to II-15, in particular, I-46 in EP 411324A on pages 5–24; formalin scavengers: SCV-1 to SCV-28, in particular, SCV-8 in EP 477932A on pages 24–29; hardeners: H-1, 4, 6, 8 and 14 in JP 1-214845 A on page 17, compounds (H-1 to H-54) represented by formulae (VII)–(XII) in U.S. Pat. No. 4,618,573 at columns 13–23, compounds (H-1 to H-76, in particular, H-14) represented by formula (6) in JP 2-214852 A in the lower right part of page 8, and the compound set forth in claim 1 of U.S. Pat. No. 3,325,287; precursors of development inhibitors: P-24, 37 and 39 in JP 62-168139 A on pages 6–7, and the compound set forth in claim 1 of U.S. Pat. No. 5,019,492, in particular, compounds 28 and 29 in column 7; antiseptics and mildew-proofing agents: I-1 to 111–43, in particular, II-1, 9, 10, 18 and III-25 in U.S. Pat. No. 4,923,790 at columns 3–15; stabilizers and antifoggants: I-1 to (14), in particular, I-1, 60, (2) and (13) in U.S. Pat. No. 4,923,793 at columns 6–16, and compounds 1–65, in particular, compound 36 in U.S. Pat. No. 4,952,483 at columns 25–32; chemical sensitizers: triphenylphosphine selenide and compound 50 in JP 5-40324 A; dyes: a-1 to b-20, in particular, a-1, 12, 18, 27, 35, 36 and b-5 in JP 3-156450 A on pages 15–18, V-1 to V-23, in particular, V-1 in the same patent on pages 27–29, F-I-1 to F-II-43, in particular, F-I-11 and F-II-8 in EP 445627A on pages 33–55, III-1 to III-36, in particular, III-1 and 3 in EP 457153A on pages 17–28, microcrystalline dispersions of Dye-1 to D-124 in WO 88/04794, 8–26, compounds 1–22, in particular, compound 1 in EP 319999A on pages 6–11, compounds D-1 to D-87 represented by formulae (1)–(3) in EP 519306A on pages 3–28, compounds 1–22 represented by formula (I) in U.S. 4,268,622 at columns 3–10, and compounds (1)–(31) represented by formula (I) in U.S. Pat. No. 4,923,788 at columns 2–9; UV absorbers: compounds (18b)-(18r) and 101–427 represented by formula (1) in JP 46-3335 A on pages 6–9, compounds (3)–(66) represented by formula (I) in EP 520938A on pages 10–44, compounds HBT-1 to HBT-10 represented by formula (III) in the same patent on page 14, and compounds (1)–(31) represented by formula (1) in EP 521823A at columns 2–9.

The present invention can be applied to a variety of color light-sensitive materials including general-purpose or motion picture color negative films, slide or TV color reversal films, color paper, color positive films and color reversal paper. The invention is also suitable for use in the film with lens units described in JP 2-32615 B and JP 3-39784 U.

Suitable bases that can be used in the invention are described in RD No. 17643, supra, on page 28, RD No. 18716, supra, on page 647, right column to page 648, left column, and RD No. 307105, supra, on page 879.

Speaking further of the light-sensitive material of the invention, the total sum of the thicknesses of all hydrophilic colloidal layers on the side having emulsion layers is preferably 28 $\mu$m or less, more preferably 23 $\mu$m or less, further preferably 18 $\mu$m or less, most preferably 16 $\mu$m or less. The layer swelling speed $T_{1/2}$ is preferably 30 seconds or less, more preferably 20 seconds or less; $T_{1/2}$ is defined as the time taken by layer thickness to reach one half the saturated layer thickness which is 90% of a maximum swollen layer thickness reached by processing with a color developer at 30° C. for 3 minutes and 15 seconds. Layer thickness means the value as measured at 25° C. under a controlled relative humidity of 55% (for 2 days); $T_{1/2}$ can be measured by using a swell-O-meter of the type described in A. Green et al., Photogr. Sci. Eng., Vol. 19, 2, pp. 124–129 and it can be adjusted by adding a hardener to gelatin used as a binder or varying the conditions under which the light-sensitive material is left to stand after application of hydrophilic colloidal layers. The degree of swelling is preferably 150–400%. The degree of swelling can be calculated from the above-defined maximum swollen layer thickness by the formula: (maximum swollen layer thickness-layer thickness)/layer thickness.

The light-sensitive material of the invention has preferably a hydrophilic colloidal layer (called "backing layer") coated to a total dry thickness of 2 $\mu$m–20 $\mu$m on the side opposite the side having emulsion layers. The backing layer preferably contains the aforementioned light absorber, filter dye, UV absorber, anti-static agent, hardener, binder, plasticizer, lubricant, coating aid and surfactant. The degree of swelling of the backing layer is preferably 150–500%.

The light-sensitive material of the invention can be developed by the ordinary methods described in RD No. 17643, supra, on pages 28–29, RD No. 18716, supra, on page 651 in left and right columns, and RD No. 307105, supra, on pages 880–881.

We now describe the processing solutions that are to be used to process color negative films in the invention.

The color developer to be used in the invention may comprise the compounds described in JP 4-121739 A in the upper right part of page 9, line 1 to the lower left part of page 11, line 4. Color developing agents that are particularly preferred for use in achieving rapid processing are 2-methyl-4-[N-ethyl-N-(2-hydroxyethyl)amino]aniline, 2-methyl-4-

[N-ethyl-N-(3-hydroxypropyl)amino]aniline and 2-methyl-4-[N-ethyl-N-(4-hydroxybutyl)amino]aniline.

These color developing agents are preferably used in amounts ranging from 0.01 to 0.08 moles, more preferably from 0.015 to 0.06 moles, most preferably from 0.02 to 0.05 moles, per liter (hereunder sometimes designated "L") of the color developer. The replenisher for the color developer contains the color developing agent at a concentration preferably 1.1–3 times, more preferably 1.3–2.5 times, the values in the above-specified ranges.

Hydroxylamine can extensively be used as a preservative in the color developer. If particularly high preserving quality is required, hydroxylamine derivatives having substituents such as an alkyl group, a hydroxyalkyl group, a sulfoalkyl group and a carboxyalkyl group are preferred; specifically, N,N-di(sulfoethyl)hydroxylamine, monomethylhydroxylamine, dimethylhydroxylamine, monoethylhydroxylamine, diethylhydroxylamine and N,N-di(carboxyethyl)hydroxylamine are preferred. Among these, N,N-di(sulfoethyl)hydroxylamine is particularly preferred. These hydroxylamine derivatives may be used in combination with hydroxylamine but preferably one or more hydroxylamine derivatives are used in place of hydroxylamine.

The preservative is preferably used in an amount ranging from 0.02 to 0.2 moles, more preferably from 0.03 to 0.15 moles, most preferably from 0.04 to 0.1 moles, per L of the color developer. As in the case of the color developing agent, the preservative is preferably contained in the replenisher at a concentration 1.1–3 times the value for the mother liquor (processing tank solution).

The color developer uses a sulfite as a chemical for preventing the color developing agent from forming a tarry oxidation product. The sulfite is preferably used in an amount ranging from 0.01 to 0.05 moles, more preferably from 0.02 to 0.04 moles, per L of the color developer. In the replenisher, the sulfite is preferably used at a concentration 1.1–3 times the values in the stated ranges.

The color developer preferably has a pH in the range of 9.8–11.0, more preferably 10.0–10.5; the pH of the replenisher is preferably set to a value that is 0.1–1.0 higher than the pH of the color developer. In order to maintain the desired pH value, known buffers are used as exemplified by carbonates, phosphates, sulfosalicylates and borates.

The color developer is preferably replenished in an amount of 80–1300 mL per square meter of the light-sensitive material. From the viewpoint of reducing the environment polluting impact, smaller amounts of replenishment are preferred as exemplified by 80–600 mL, with 80–400 mL being more preferred.

The concentration of bromide ions in the color developer is usually in the range of 0.01–0.06 moles per L of the color developer. In order to improve discrimination and graininess while keeping sensitivity but restraining fog, the concentration of bromide ions is preferably set at 0.015–0.03 moles per L of the color developer. If the concentration of bromide ions is set to lie within the stated ranges, the replenisher may contain bromide ions at a concentration calculated by the following formula, provided that no bromide ions are preferably contained in the replenisher if C takes a negative value:

$$C=A-W/V$$

where C is the concentration of bromide ions (mol/L) in the replenisher for the color developer, A is the desired concentration of bromide ions (mol/L) in the color developer, W is the quantity of bromide ions (mol) that are released from 1 $m^2$ of the light-sensitive material into the color developer upon color development, and V is the quantity (L) in which the replenisher for the color developer is supplied per square meter of the light-sensitive material.

If the amount of replenishment is reduced or if the concentration of bromide ions is set at high level, sensitivity is preferably increased by using development accelerators such as pyrazolidones typified by 1-phenyl-3-pyrazolidone and 1-phenyl-2-methyl-2-hydroxymethyl-3-pyrazolidone or thioether compounds typified by 3,6-dithia-1,8-octanediol.

The processing solution having bleaching capability that is to be used in the invention permits the application of the compounds and processing conditions described in JP 4-125558 A, the lower left part of page 4, line 16 to the lower left part of page 7, line 6.

Preferred bleaching agents are those which have redox potentials of 150 mV and higher. Specifically, the compounds described in JP 5-72694 A and JP 5-173312 A are preferred; in particular, 1,3-diaminopropanetetraacetic acid and a ferric complex salt of the compound set forth as Specific Example 1 on page 7 of JP 5-173312 A are preferred.

For better biodegradability, ferric complex salts of the compounds described in JP 4-251845 A, JP 4-268552 A, EP 588,289, EP 591,934 and JP 6-208213 A are preferably used as bleaching agents. The concentration of these bleaching agents is preferably in the range of 0.05–0.3 moles per L of the solution having bleaching capability and, in particular, for the purpose of reducing the emission to the environment, a preferred design value is in the range of 0.1–0.15 moles per L of the solution having bleaching capability. If the solution having bleaching capability is a bleaching solution, a bromide is preferably contained in an amount of 0.2–1 mole, more preferably 0.3–0.8 moles, per L of the bleaching solution.

The replenisher for the solution having bleaching capability should in principle contain a relevant ingredient in a concentration that is calculated by the following formula:

$$CR=CT\times(V1+V2)/V1+CP$$

where CR is the concentration of the ingredient in the replenisher, CT is the concentration of the ingredient in the mother liquor (processing tank solution), CP is the concentration of the ingredient that has been consumed during processing, V1 is the quantity (mL) of the replenisher having bleaching capability that is supplied per square meter of the light-sensitive material, and V2 is the carryover (mL) from the preceding bath by 1 $m^2$ of the light-sensitive material. Thus, the consentration of the ingredient is kept constant in the mother liquor.

Preferably, the bleaching solution also contains a pH buffer and it is particularly preferred to use less odorous dicarboxylic acids such as succinic acid, maleic acid, malonic acid, glutaric acid and adipic acid. It is also preferred to use known bleach accelerators that are described in JP 53-95630 A, RD No. 17129 and U.S. Pat. No. 3,893,858.

The bleaching solution is preferably replenished with a bleach replenisher in an amount of 50–1000 mL, more preferably 80–500 mL, most preferably 100–300 mL, per square meter of the light-sensitive material. It is also preferred to perform aeration on the bleaching solution.

The processing solution having fixing capability permits the application of the compounds and processing conditions described in JP 4-125558 A, the lower left part of page 7, line 10 to the lower right part of page 8, line 19.

In particular, for faster fixing and better preservation, compounds represented by general formulae (I) and (II) in JP 6-301169 A are preferably contained, either alone or in combination, in the processing solution having fixing capability. Using p-toluenesulfinates, as well as the sulfinic acid mentioned in JP 1-224762 A is also preferred for the purpose of improving preservation.

From the viewpoint of effective desilvering, the solution having bleaching capability and the solution having fixing capability preferably use ammonium as a cation. On the other hand, for the purpose of reducing environmental pollution, the ammonium content should be reduced, preferably to zero.

In the steps of bleaching, bleach-fixing (blix) and fixing, it is particularly preferred to perform jet agitation as described in JP 1-309059 A.

In the step of blix or fixing, the replenisher is preferably supplied in an amount of 100–1000 mL, more preferably 50–700 mL, most preferably 200–600 mL, per square meter of the light-sensitive material.

In the steps of blix and fixing, various kinds of silver reclaiming apparatus are preferably installed in-line or off-line to recover silver. If silver reclaiming apparatus are installed in-line, the silver concentration in the processing solutions can be reduced while processing and, as the result, the amount of replenishment can be reduced. It is also preferred to recover silver off-line so that the residual solution is recycled as the replenisher.

The step of blix or fixing may be composed of a plurality of processing tanks that are cascade-connected to permit a counter-current flow through multiple stages. To assure a good balance with the size of the processor, it is generally efficient to cascade two tanks, with the ratio of the time of processing in the first tank to the time of processing in the second tank being preferably adjusted to lie in the range of 0.5:1–1:0.5, more preferably in the range of 0.8:1–1:0.8.

From the viewpoint of better preservation, the blix solution and the fixing solution preferably contain a free chelating agent that is not a metal complex. As such chelating agents, biodegradable chelating agents described in connection with the bleaching solution are preferably used.

For the steps of washing and stabilizing, the disclosure in JP 4-125558 A, supra, the lower right part of page 12, line 6 to the lower right part of page 13, line 16 is preferably applied. In particular, the stabilizing solution may use, instead of formaldehyde, the azolylmethylamines described in EP 504,609 and 519,190 or the N-methylolazoles described in JP 4-362943 A or, alternatively, two-equivalent magenta couplers may be used to form a surfactant solution that is free from formaldehyde or any other image stabilizers; either approach is preferred from the viewpoint of keeping a clean working environment. In order to reduce dust deposition on the magnetic recording layer coated on the light-sensitive material, the stabilizing solution described in JP 6-289559 A may preferably be used.

Washing water and the stabilizing solution are preferably replenished with an amount of 80–1000 mL, more preferably 100–500 mL, most preferably 150–300 mL, per square meter of the light-sensitive material not only from the viewpoint of securing the washing or stabilizing function but also for the purpose of keeping a clean environment by reducing the emission of waste solution. In the processing based on the stated supply of replenishment, known mildew-proofing agents such as thiabendazole, 1,2-benzisothiazolin-3-one and 5-chloro-2-methylisothiazolin-3-one, antibiotics such as gentamicin, and water deionized with ion-exchange resins, etc. are preferably used in order to prevent bacterial and mold proliferation. Deionized water is more effectively used in combination with germicides or antibiotics.

It is also preferred that the solution in the washing water tank or stabilizing solution tank is subjected to treatment with a reverse osmotic membrane as described in JP 3-46652 A, JP 3-53246 A, JP 355542 A, JP 3-121448 A and JP 3-126030 A so that the amount of replenishment is reduced; the reverse osmotic membrane to be used is preferably of a low-pressure type.

In the processing according to the invention, it is particularly preferred to implement compensation for the evaporation of processing solutions as described in JIII Journal of Technical Disclosure No. 94-4992. A particularly preferred method is by making correction using the temperature and humidity information for the environment of installation of the processor on the basis of formula 1 on page 2 of the same Disclosure. Water to be used in compensation for the evaporation of processing solutions is preferably taken from the washing replenisher tank and, in that case, deionized water is preferably used as washing replenisher.

The processing agents to be preferably used in the invention are described in JIII Journal of Technical Disclosure, supra, on page 3, right column, line 15 to page 4, left column, line 32. The processor to be preferably used with those agents is a film processor described on page 3, right column, lines 22–28.

For specific examples of the processing agents, automatic processor and the method of compensation for the evaporation of processing solutions, reference should be had to JIII Journal of Technical Disclosure, supra, page 5, right column, line 11 to page 7, right column, last line.

The processing agents to be used in the invention may be supplied in various forms including solutions preliminarily formulated to have the concentration for use, liquid concentrates, granules, powders, tablets, pastes and emulsions. As examples of such processing agents, a solution placed in a container of low oxygen permeability is disclosed in JP 63-17453 A, a powder or granules as vacuum-packaged is disclosed in JP 4-19655 A and JP 4-230748 A, granules containing a water-soluble polymer is disclosed in JP 4-221951 A, tablets are disclosed in JP 51-61837 A and JP 6-102628 A, and a paste-like processing agent is disclosed in JP 57-500485 A. While any one of these processing agents can be used with advantage, solutions preliminarily formulated to have the concentration for use are preferably used.

Containers for these processing agents are made of polyethylene, polypropylene, poly(vinyl chloride), poly (ethylene terephthalate), nylon, etc. which are used either alone or in composite form. A suitable material is chosen in accordance with the required level of oxygen permeability. For solutions such as color developers that are readily oxidized, materials of low oxygen permeability are preferred and to mention a specific example, a composite of poly (ethylene terephthalate) or polyethylene with nylon is preferred. The materials listed above are preferably used to make containers with a wall thickness of 500–1500 $\mu$m so that the oxygen permeability is adjusted to be not higher than 20 $mL/m^2 \cdot 24$ hrs·atm.

We next describe the processing solutions that are to be used to process color reversal films in the invention.

Details about the procedures of processing color reversal films are given in Known Technologies, No. 6, published by Aztec, Ltd., Apr. 1, 1991, on page 1, line 5 to page 10, line 5 and on page 15, line 8 to page 24, line 2. Any of the disclosures given in those passages can be applied with advantage.

In the processing of color reversal films, the image stabilizer is contained in either the compensating bath or the final bath. Exemplary image stabilizers include not only formalin but also formaldehyde sodium bisulfite and N-methylolazoles. From the viewpoint of keeping a clean working environment, formaldehyde sodium bisulfite or N-methylolazoles are preferred and N-methyloltriazole is a particularly preferred N-methylolazole. The remarks made about the color developer, bleaching solution, fixing solution and washing water in connection with the processing of color negative films can also be applied with advantage to the processing of color reversal films.

Two preferred agents for processing color reversal films that incorporate the remarks given above are E-6 Processing Agent of Eastman Kodak Company and CR-56 Processing Agent of Fuji Photo Film Co., Ltd.

The color photographic material of the invention is also suitable as a negative film for the Advanced Photo System (hereunder referred to as the AP System), which may be exemplified by NEXIA A, NEXIA F and NEXIA H (ISO 200/100/400 in that order) manufactured by Fuji Photo Film Co., Ltd. (hereunder referred to as Fuji Film), as well as other similar products that have the film processed to an AP System format and contained in a dedicated cartridge. These cartridge films for the AP System are used after being loaded into a camera for the AP System such as EPION SERIES (e.g. EPION 300Z) manufactured by Fuji Film. The color photographic material of the invention is also suitable for use with a film with lens unit such as FUJI COLOR UTSURUNDESU SUPER SLIM manufactured by Fuji Film.

Films exposed with the above-mentioned cameras or film with lens units are processed for print by a minilab system through the following steps:

(1) received (the customer hands out the exposed cartridge film)

(2) detaching (the film is transferred from the cartridge to the intermediate cartridge for development)

(3) developing the film;

(4) reattaching (the developed negative film is replaced in the initial cartridge);

(5) printing (prints of three types C/H/P and an index print are reproduced continuously and automatically on color paper (preferably, SUPER FA8 manufactured by Fuji Film);

(6) collating and shipping (the cartridge and the index print are collated with the ID number and shipped together with the prints).

Preferred examples of the minilab capable of implementing these procedures are Fuji Film Minilab Champion Super FA-298, FA-278, FA-258 and FA-238 and Fuji Film Digital Lab System Frontier. Film processors for use with Minilab Champion include FP922AL, FP562B, FPS62B, AL, FP362B, and FP362B, AL, and recommended processing chemicals are Fuji Color JustIt CN-16L and CN-16Q. Useful printer processors include PP3008AR, PP3008A, PP1828AR, PP1828A, PP1258AR, PP1258A, PP728AR and PP728A, and recommended processing chemicals are Fuji Color JustIt CP-47L and CP-40FAII. In the Frontier System, a scanner & image processor SP-1000 and a laser printer & paper processor LP-1000P or a laser printer LP-1000W are used. The detacher to be used in the detaching step and the reattacher to be used in the reattaching step are preferably DT200/DT100 and AT200/AT100, respectively, that are both manufactured by Fuji Film.

The AP System has the benefit of offering amusement by photo joy systems based on Digital Image Workstation Aladdin 1000 manufactured by Fuji Film. For example, an developed AP System cartridge film may be directly loaded into Aladdin 1000, or image information on a negative film, a positive film or print is entered with the aid of a 35-mm film scanner FE-550 or a flat head scanner PE-550 and the obtained digital image data can be readily processed and edited. The data can be output as print by a digital color printer NC-550AL of a light fixing, thermal color print system or Pictrography 3000 of a laser exposing, thermal development and transfer system, or by existing lab equipment via a film recorder. Aladdin 1000 can also permit digital information to be directly output to a flexible disk or a Zip disk or indirectly output to CD-R via a CD writer.

At home, the customer may simply load the developed AP System cartridge film on a photo player AP-1 of Fuji Film to enjoy pictures on a TV screen. If the cartridge film is loaded on a photo scanner AS-1 of Fuji Film, image information can be continuously sent to a personal computer at high enough speed. In order to enter a film, a print or a 3D object into a personal computer, a photo vision FV-10/FV-5 of Fuji Film may be used. If desired, image information recorded on a flexible disk, a Zip disk, CD-R or a hard disk can be variously processed for entertainment on a personal computer by means of Photo Factory which is an application software package manufactured by Fuji Film. In order to output prints of high image quality from the personal computer, a Fuji Film digital color printer NC-2/NC-2D which is a light fixing, thermal color printing system may be used with advantage.

The developed AP System cartridge film may preferably be contained in Fuji Color Pocket Album (AP-5 Pop L, AP-1 Pop L or AP-1 Pop KG) or Cartridge File 16.

As described above, the color light-sensitive material according to the first aspect of the invention has four light-sensitive layers, red-, green-, blue- and cyan-sensitive layers, and after exposure, it is developed to form respective colors, for example, cyan, magenta, yellow and an infrared or ultraviolet color; as a result, by using image input means such as a scanner having light-sensitive portions that have spectral sensitivities at the spectral absorption wavelengths of the color materials in the respective light-sensitive layers, four kinds of image information for not only R (red), G (green) and B (blue) but also cyan (C) can be read photoelectrically.

Therefore, the color light-sensitive material of the invention allows the fourth light-sensitive layer to exhibit its performance adequately so that more image information is yielded than in the prior art to realize more faithful color reproduction in reproduced image.

The above-described color light-sensitive material has three basic light-sensitive layers, a red-sensitive layer (RL), a green-sensitive layer (GL) and a blue-sensitive layer (BL), plus a cyan-sensitive layer (CL) as the fourth light-sensitive layer. However, this is not the sole case of the color light-sensitive material according to the first aspect of the invention and the fourth light-sensitive layer may be of any type other than the cyan-sensitive layer. For example, the fourth light-sensitive layer may be a yellow-sensitive layer (YL) or both CL and YL may be included, the former as the fourth light-sensitive layer and the latter as a fifth light-sensitive layer. If desired, six or more light-sensitive layers may be provided. It should be noted that by providing five or more light-sensitive layers, the color light-sensitive material of the invention can yield more image information to realize even better color reproduction in reproduced image.

Thus, the color light-sensitive material of the invention also allows the fourth and any additional light-sensitive layers to form color after exposure and development, thereby yielding at least four kinds of image information. Unlike the color light-sensitive material disclosed in JP 11-305396 A, supra, the color light-sensitive material of the invention is not subject to any constraint of chemical reactions due, for example, to the DIR compound and colored coupler contained in the fourth light-sensitive layer in order to attain interimage effects on the red-sensitive layer; instead, the performance of the fourth and any additional light-sensitive layers can be exhibited adequately and the precision in color reproduction can be enhanced without being limited by the potentials of the light-sensitive material used and, as a result, the produced image has better color reproduction.

Since it is not essential for the color light-sensitive material of the invention to allow the fourth and any additional light-sensitive layers to contain the DIR compound, colored coupler, etc. which produce interimage effects on other layers by chemical reactions mediated with the developer, the present invention is applicable not only to color light-sensitive materials which uses a liquid developer of the conventional type for development but also color light-sensitive materials that can be developed without a liquid developer, as well as color light-sensitive materials that are inherently incapable of providing interimage effects, as exemplified by thermally developable color light-sensitive materials.

If the color light-sensitive material of the invention is of such a type that the peak wavelength of the spectral absorption of the color material in the fourth or any additional light-sensitive layer as illustrated by a cyan-sensitive layer is in the infrared or ultraviolet region, four kinds of image information are obtained by using image input means such as a scanner having the corresponding four light-sensitive portions and prints featuring better color reproduction in the reproduced image can of course be output on the basis of the four kinds of image information. What is more, since the fourth light-sensitive layer forms color in the infrared or ultraviolet region, the color light-sensitive material of the invention is also applicable to a conventional scanner having only three (RGB) light-sensitive portions and a digital photo printer fitted with this scanner; if desired, the color light-sensitive material of the invention may be applied to the conventional analog photo printer which performs planar exposure.

In particular, if the color light-sensitive material of the invention has the fourth and any additional light-sensitive layers that contain not only a color material forming color in the infrared or ultraviolet region but also a DIR compound or a colored coupler that can produce interimage effects on other layers and if it is of a type that uses a conventional liquid developer for development, the material will be much more suitable not only for digital scan exposure but also analog exposure including planar exposure and slit scan exposure.

Described above are the basic design features of the color light-sensitive material according to the first aspect of the invention.

We next describe an image processing method according to the second aspect of the invention, as well as an image processing apparatus according to its third aspect.

Figure 2:
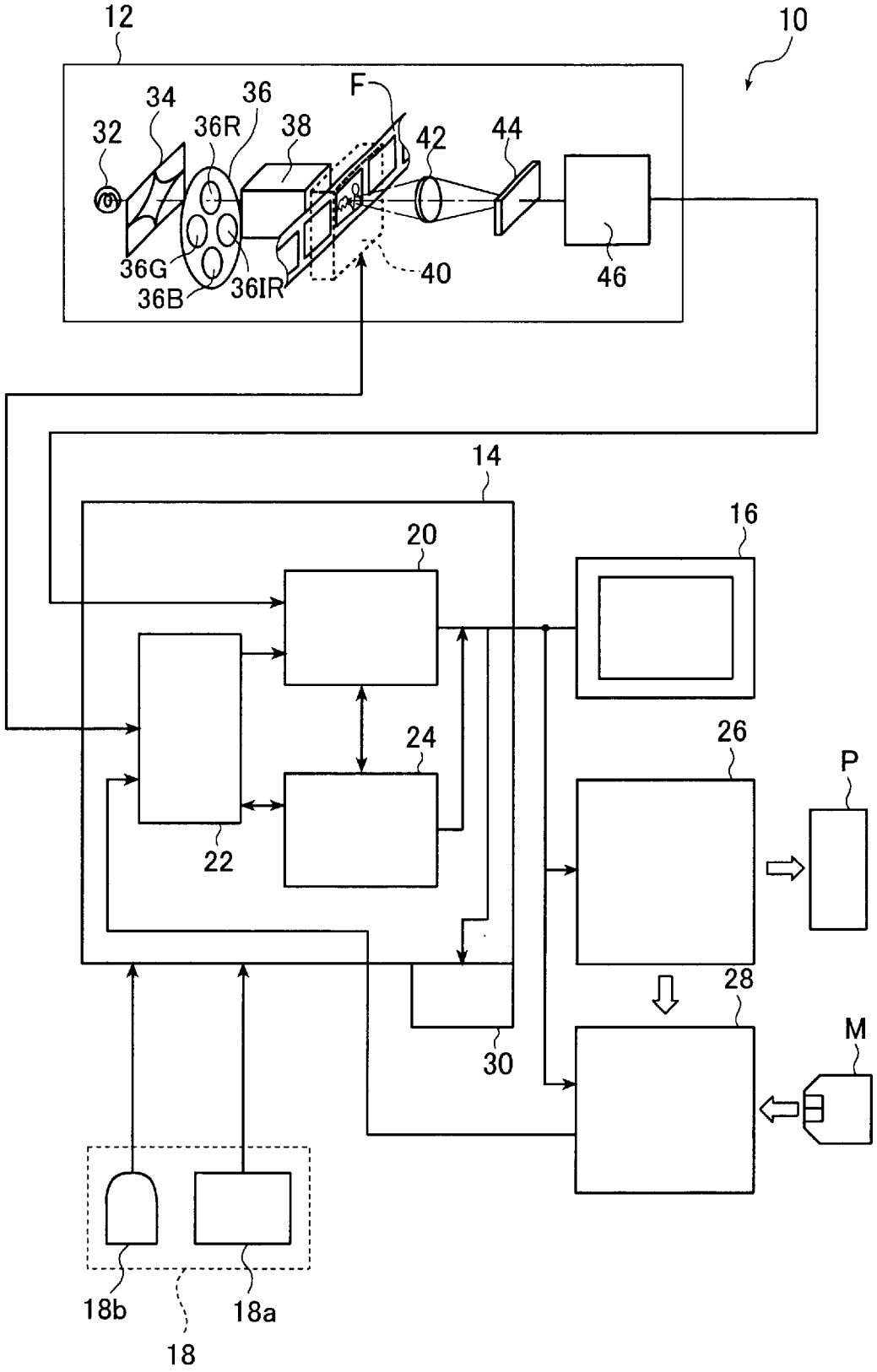
FIG. 2 is a diagram showing in conceptual form an example of the image processing apparatus of the invention.

FIG. 2 shows schematically an example of the image processing apparatus according to the third aspect of the invention which is used to implement the image processing method according to its second aspect.

The image processing apparatus generally indicated by 10 in FIG. 2 comprises a 4-channel scanner 12, an image processing section 14, a display 16 and a manipulating unit 18. The 4-channel scanner 12 functions as an image input means or device for reading image information (input image data) for four different colors from a negative film F which is the color light-sensitive material of the invention after exposure and development; the image processing section 14 performs color transformation and various other image processing schemes on the four or more kinds of color image information (input image data) that have been entered by means of the scanner 12; the display 16 represents a reproduced image of the image data being output from the image processing section 14; the manipulating unit 18 has a keyboard 18*a*, a mouse 18*b*, etc. that are used to enter data into various members of the image processing apparatus 10 and give operating instructions to them.

The image processing section 14 comprises an image converting portion 20, a spectral sensitivity input portion 22 and an image memory (frame memory) 24. The image converting portion 20 functions as image converting means and performs color transformation on the four or more kinds of color image information (input image data) as entered by means of the scanner 12 so that they are converted to image data in a standard color space and image data that can be transferred to the output device; the spectral sensitivity input portion 22 functions as means for entering the spectral sensitivities of the negative film F; the image memory 24 stores the input image data as output from the scanner 12, the image data from the image converting portion 20, etc.

Also connected to the image processing apparatus 10 are a digital printer 26, a driver 28, a communication section 30, etc. The digital printer 26 outputs a hard copy such as a photographic print P on the basis of the converted image data from the image processing section 14; the driver 28 records/reproduces the converted image data from the image processing section 14, as well as the spectral sensitivity waveforms, spectral absorption waveforms, etc. for the film F on a data recording medium M such as a magnetic, optical or magneto-optical recording medium exemplified by MO, FD or CD-R; the communication section 30 distributes/receives the converted image data from the image processing section 14, as well as the spectral sensitivity waveforms, spectral absorption waveforms, etc. for the film F via a communication network such as the Internet.

The image processing apparatus 10 of the invention may combine with the digital printer 26, driver 28 and the communication section 30 to form a digital photo printer.

In the following description, negative film F having a red-sensitive layer containing a cyan coupler, a green-sensitive layer containing a magenta coupler, a blue-sensitive layer containing a yellow coupler and a cyan-sensitive layer as a fourth light-sensitive layer containing an infrared (IR) coupler is considered as a typical example of the color light-sensitive material of the invention and a picture of a subject is taken with this negative film F, which is then developed to allow it to form different colors in the respective light-sensitive layers; the image processing method and apparatus of the invention are described with reference to the thus processed negative film F. Needless to say, this is not the sole case of the invention.

The scanner 12 reads the image information (input image data) of four different colors R, G, B and IR as recorded on the R, G, B and cyan sensitive layers in the exposed and developed negative film F of the invention. It comprises the following components: a light source 32 that issues light containing wavelength components of R, G, B and IR; a variable diaphragm 34 that controls how much of the emerging light from the light source 32 should be incident on the film F; a color filter disc 36 that is furnished with four color filters 36R, 36G, 36B and 36IR for separating a taken image on the film F into three primary colors R, G and B as well as IR and which allows only one color filter to act on the optical path at a time; a diffuser box 38 by which the reading light incident on the film F is diffused to illuminate its entire surface uniformly; a dedicated film carrier 40 detachably installed on the body of the scanner 12 for retaining the film F in the reading position; an imaging lens unit 42 for focusing projection light that carries the taken image on the film F; an area CCD sensor 44 as a photosensor that has the light projecting the entire area of the taken image on the film F focused on its light-receiving face and which reads the focused image through photoelectric conversion; and a data output section 46 that comprises an amplifier, an A/D (analog-to-digital) converter, an LOG converter circuit, corrective circuits for performing various kinds of darkness correction, shading correction and defective pixel correction, etc. and which delivers output signals from the CCD sensor 44 as digital image data.

The scanner 12 operates as follows: the light issued from the light source 32 has its quantity controlled by means of the variable diaphragm 34; the adjusted light then passes through the color filter disc 36, say, color filter 36R for color adjustment and is diffused in the diffuser box 38 to make reading light which is incident on one frame of the film F as it is retained in a specified reading position by means of the carrier 40; the incident light is transmitted through the film F to form projection light which carries the taken image on the film F. The projection light from the film F is focused by the imaging lens unit 42 on the light-receiving face of the area CCD sensor 44 to project the image thereon; and the sensor 44 photoelectrically reads the projected image on a pixel-by-pixel basis.

The thus read image signals are sent to the data output circuit 46, where they are converted to digital image data.

During the operation of the scanner 12, color filters 36R, 36G, 36B and 36IR in the color filter disc 36 are sequentially inserted into the optical path and the above-described reading step is performed four times, whereupon the images of respective colors formed in the individual light-sensitive layers of the film F are separated into four colors consisting of three primaries R, G and B and IR and read photoelectrically by means of the area CCD sensor 44.

Therefore, color filters 36R, 36G, 36B and 36IR in the color filter disc 36 combine with the area CCD sensor 44 to make four light-sensitive portions according to the invention that have different spectral sensitivity waveforms.

In the illustrated case, the light source 32 is designed to issue light having both the visible wavelength band containing R, G, B wavelength components and the IR wavelength band and this can be realized by, for example, an incandescent lamp. However, this is not the sole case of the invention and two separate light sources (not shown), one for issuing light in the visible wavelength band and the other for issuing light in the IR wavelength band, may be lit up simultaneously and the light in the visible band and the light in the IR band are mixed uniformly in the diffuser box 38 to produce diffused light. Alternatively, the two light sources may be turned on selectively; in this alternative case, if, with the source for the light in the visible wavelength band being turned on, the source for the light in the IR wavelength band is turned on to read the IR image, the color filter 36IR in the color filter disc 36 may not be used but the light in the IR band is allowed to pass through the color filter disc 36 without filtering.

Figure 3A:
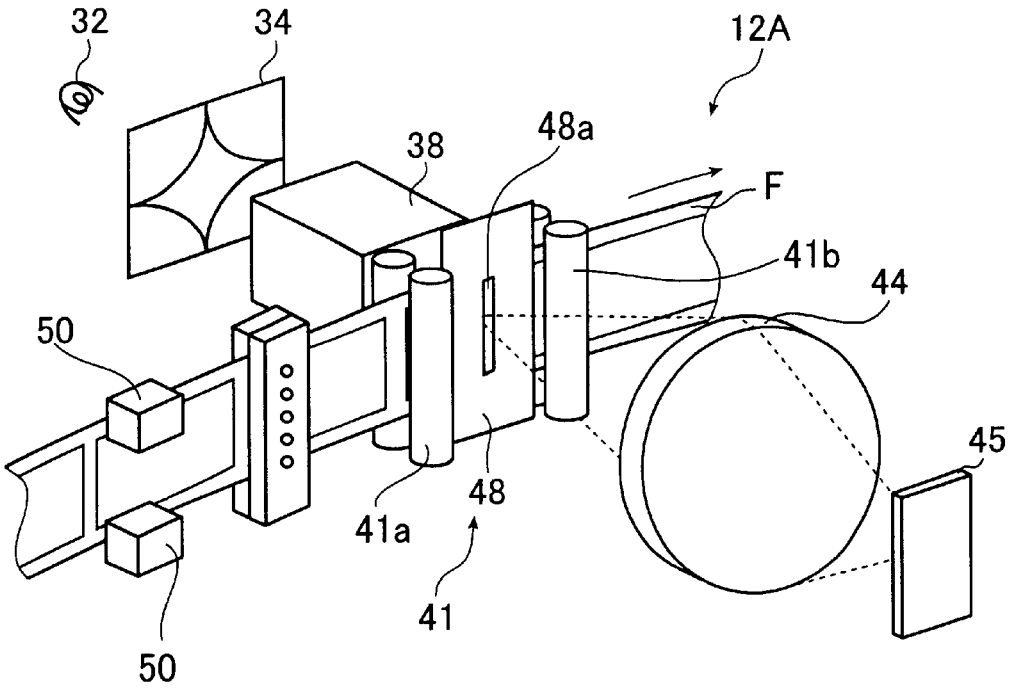
FIG. 3A is a perspective view showing in conceptual form another example of the scanner used in the image processing apparatus shown in FIG. 2.
Figure 3B:
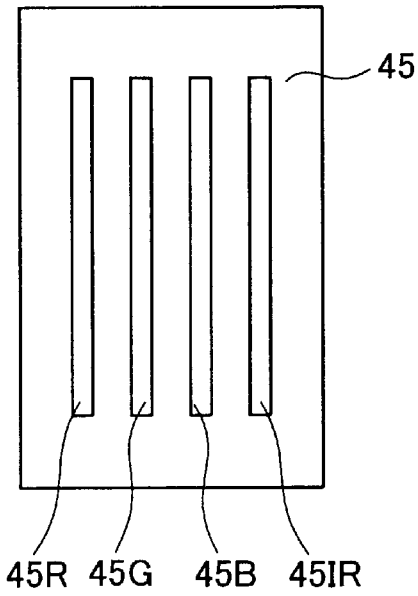
FIG. 3B is a plan view showing in conceptual form an example of the line CCD sensors used in the scanner shown in FIG. 3A.

The scanner 12 in FIG. 2 uses the area CCD sensor 44 and the color filters in the color filter disc 36 are successively inserted into the optical path so that the images in the respective light-sensitive layers of the film F are (that is, the projection light is) separated into four colors for reading. This is not the sole case of the scanner 12 that can be used in the image processing apparatus 10 of the invention and it may be replaced by a scanner 12A which is shown in FIGS. 3A and 3B; instead of the color filter disc 36, the scanner 12A uses a line sensor assembly 45 consisting of four line CCD sensors 45R, 45G, 45GB and 45IR which respectively correspond to three primaries R, G and B, and IR. As the film F is transported for scan by means of a carrier 41, slit reading light (projection light) is applied to read an image; in other words, the scanner 12A reads images by "slit scanning".

The four line CCD sensors 45R, 45G, 45B and 45IR for the respective colors are such that they have R, G, B and IR filters in strip form provided (attached) integrally on their respective light-receiving faces.

Hence, the four line CCD sensors 45R, 45G, 45B and 45IR in the line sensor assembly 45 of the scanner 12A form four light-sensitive portions having different spectral sensitivity waveforms according to the invention.

The line sensor assembly indicated by 45 in FIG. 3B has the four line CCD sensors 45R, 45G, 45B and 45IR arranged parallel on a common plane. If desired, three line CCD sensors 45R, 45G and 45B for the light in the visible wavelength band may be provided separate from the line CCD sensor 45IR for the light in the IR wavelength band. In this alternative case, the four line CCD sensors 45R, 45G, 45B and 45IR may be combined with a light source unit 32 which consists of two light sources, one for issuing the light in the visible wavelength band and the other for the light in the IR wavelength band, and which is selectively operated to switch from one light source to the other.

A photoelectric reading sensor other than the CCD sensor may be used as the photosensor.

In the case of reading IR colored images, a scanner designed to have not only the image-reading R, G and B photosensors but also an IR photosensor for detecting flaws and other film defects may be used as the 4-channel scanner 12 of the invention with advantage since the defect-detecting IR photosensor in such a scanner needs simple modification to be effectively applied for reading of IR colored images.

The carrier 41 has a variety of dedicated carrier types available that are compatible with 12-, 24- or 36-exposure 135-size films, APS films, etc. and as shown in FIG. 3A, it comprises transport roller pairs 41*a* and 41*b* for transporting the film F for scan, a mask 48 having a slit 48*a*, through which the projection light from the film F passes to be defined to the form of predetermined slit light, and magnetic information read/write units 50.

The transport roller pairs 41*a* and 41*b* are spaced apart such that a specified reading position is in between in an auxiliary scan direction. As retaining the film F in the reading position, the roller pairs 41*a* and 41*b* transport the film F along its length, namely, in an auxiliary scan direction perpendicular to the main scan direction in which the line CCD sensors 45R, 45G, 45B and 45IR in the line sensor assembly 45 extend.

The mask 48 is located between the transport roller pairs 41*a* and 41*b* and the slit 48*a* extends in the main scan direction in alignment with the reading position.

As in the case of APS films, the magnetic information read/write units 50 read the following information from a magnetic layer provided on the non-emulsion side of the film F; film information such as cartridge ID and film types, shooting information such as date and time of shooting, use or non-use of an electronic flash, position and direction of shooting, and magnification, as well as various added information.

Turning back to the image converting portion 20 in the image processing section 14, it performs color transformation on the four kinds of color image information (input image data) as read by the scanner 12, whereupon they are converted to image data for a standard color space or image data that can be transferred to an output device.

In the image converting portion 20, the four kinds of input (digital) image data as sent from the scanner 12 are first converted to optical densities (B, G, R and IR as counted from the shorter wavelength end) for individual pixels.

In the present invention, conversion to optical densities (B, G, R, IR) on a pixel-by-pixel basis may be carried out in the scanner 12.

In the next step, the obtained optical densities (B, G, R, IR) are converted to analytical densities (B', G', R', IR') via a 4×4 matrix MTXA.

The 4×4 matrix MTXA used here may be represented by the following equation (6) and the analytical densities (B', G', R', IR') may be determined by the following equation (7).

$$MTXA = \begin{pmatrix} 1.00 & 0.07 & 0.04 & 0.03 \\ 0.07 & 1.00 & 0.09 & 0.02 \\ 0.16 & 0.06 & 1.00 & 0.92 \\ 0.15 & 0.06 & 0.26 & 1.00 \end{pmatrix}^{-1} \tag{6}$$

$$\begin{pmatrix} B' \\ G' \\ R' \\ IR' \end{pmatrix} = MTXA \begin{pmatrix} B-0.63 \\ G-0.73 \\ R-0.49 \\ IR-0.56 \end{pmatrix}$$

$$= \begin{pmatrix} 1.00 & 0.07 & 0.04 & 0.03 \\ 0.07 & 1.00 & 0.09 & 0.02 \\ 0.16 & 0.06 & 1.00 & 0.92 \\ 0.15 & 0.06 & 0.26 & 1.00 \end{pmatrix}^{-1} \begin{pmatrix} B-0.63 \\ G-0.73 \\ R-0.49 \\ IR-0.56 \end{pmatrix} \tag{7}$$

Figure 4:
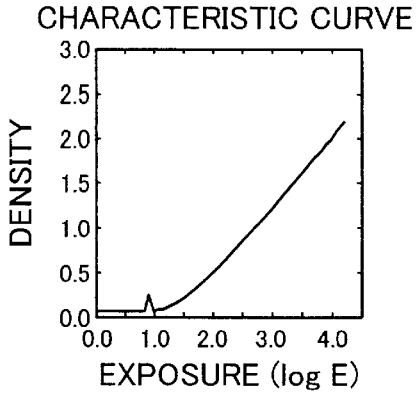
FIG. 4 is a graph showing an exemplary characteristic curve that may be used to implement the image processing method of the invention.

In the next step, the obtained analytical densities (B', G', R', IR') are converted to amounts of exposure (r, g, b, ir) via a characteristic curve, for example, the one illustrated in FIG. 4.

In the last step, the amounts of exposure (r, g, b, ir) are converted to tristimulus values XYZ in the XYZ calorimetric system (CIE 1931 standard calorimetric system) via a 3×4 matrix.

The 3×4 matrix MTXB used here may be represented by the following equation (8) and the tristimulus values XYZ in the XYZ colorimetric system may be determined by the following equation (9).

$$MTXB = \begin{pmatrix} 0.54 & 0.49 & 0.18 & -0.21 \\ 0.26 & 0.66 & 0.03 & 0.04 \\ 0.00 & -0.05 & 0.93 & 0.12 \end{pmatrix} \tag{8}$$

$$\begin{pmatrix} X \\ Y \\ Z \end{pmatrix} MTXB = \begin{pmatrix} r \\ g \\ b \\ ir \end{pmatrix}$$

$$= \begin{pmatrix} 0.54 & 0.49 & 0.18 & -0.21 \\ 0.26 & 0.66 & 0.03 & 0.04 \\ 0.00 & -0.05 & 0.93 & 0.12 \end{pmatrix} \begin{pmatrix} r \\ g \\ b \\ ir \end{pmatrix} \tag{9}$$

In a preferred embodiment of the invention, the image converting portion 20 performs color transformation on the basis of the spectral sensitivity waveforms of the film F as entered by the spectral sensitivity input portion 22.

It is preferable to carry out the conversions as stated above, that via the 3×4 matrix MTXB represented by the above equation (8) among others, on the basis of the spectral sensitivity waveforms of the film F as entered by the spectral sensitivity input portion 22.

The spectral sensitivity input portion 22 which receives the spectral sensitivity waveforms of the film F and supplies them to the image converting portion 20 may be implemented in various ways.

In one example, the spectral sensitivity waveforms of the film F which vary from one film type to another are stored in the spectral sensitivity input portion 22 in association with a plurality of film types and the film type to be used is entered into the spectral sensitivity input portion 22 by means of the keyboard 18*a* and the mouse 18*b* in the manipulating unit 18 so as to choose the appropriate spectral sensitivity waveforms for the film F of interest. If desired, the spectral sensitivity waveforms of the film F may be stored in association with film types not in the spectral sensitivity input portion 22 but in one area of the image memory 24. Instead of entering the film type into the spectral sensitivity input portion 22 from the manipulating unit 18, the type of the film F may automatically be input to the spectral sensitivity input portion 22 as it is read from the magnetic layer of the film by means of the magnetic information read/write units 50 in the carrier 40 or 41.

If desired, the spectral sensitivity waveforms of the film F as recorded on a data recording medium M may be read out of it by means of the driver 28 and entered into the spectral sensitivity input portion 22. Alternatively, the spectral sensitivity waveforms of the film F may be downloaded either from a database connected to the image processing apparatus 10 or from an external database via the communication section 30 and entered into the spectral sensitivity input portion 22.

The image memory 24 is a frame memory which stores on a frame-by-frame basis the input image data for the film F as output from the scanner 12 or the image data as output from the image converting portion 20. If desired, the spectral sensitivity waveforms of the film F may be stored in a selected area of the image memory 24 in association with film types; the image memory 24 may also store the information, data, etc. that are necessary to operate the image processing apparatus 10.

Display 16 is a device for displaying images, which represents the converted image data as it is output from the image converting portion 20 of the image processing section 14 or the input image data (yet to be converted) as it is read out of the image memory 24 or an image that reproduces the converted image data. The display 16 may also represent pictures that aid in manipulating the image processing apparatus 10, devices connected to it, the digital printer 26, driver 28 and the communication section 30 and giving operating instructions to them or in entering various kinds of data such as the film type.

In the illustrated case, a film F having the IR color forming, cyan-sensitive layer as the fourth light-sensitive layer is used as the color light-sensitive material of the invention and the scanner 12 having R, G, B and IR filters 36R, 36G, 36B and 36IR as well as the CCD sensor 44 or the scanner 12A having R, G, B and IR CCD sensors 45R, 45G, 45B and 45IR is used as the image input means that reads a taken image on a film which has been exposed and developed. This is not the sole case of the invention and various modifications are possible; for example, a non-cyan-sensitive layer such as a yellow-sensitive layer may be used as the fourth light-sensitive layer or the IR color forming layer may be replaced by a UV (ultraviolet) color forming layer or any of the light-sensitive layers that form colors other than R, G and B; needless to say, the color light-sensitive material of the invention may have a fifth and ensuing light-sensitive layers and a scanner or the like that has as light-sensitive portions corresponding to the color forming wavelengths (i.e., spectral absorption wavelengths) and the spectral absorption waveforms of the light-sensitive layers present those photosensors (photoelectric reading means) which have sensitivity in the bands of the wavelengths is used as the image input means.

The film F may be developable by a wet method using a liquid developer or it may be thermally developable or of any other type.

Described are the basic structural features of the image processing apparatus according to the third aspect of the invention.

On the pages that follow, the operation of the image processing apparatus according to the third aspect of the invention and an example of the image processing method according to its second aspect are described with reference to FIGS. 2 and 4 but they of course are not the sole examples of the invention.

To begin with, prepare a color light-sensitive material containing at least four light-sensitive layers that have color sensitivity in the visible range with small overlaps between their spectral sensitivities and which form color with different spectral absorption waveforms after development; an example of such color light-sensitive material is a negative film F which has, as already described, a red (R) sensitive layer containing a cyan coupler, a green (G) sensitive layer containing a magenta coupler, a blue (B) sensitive layer containing a yellow coupler and a cyan sensitive layer as the fourth light-sensitive layer which contains an infrared (IR) coupler.

In the next step, the film F is loaded into a camera or the like and a picture of the subject is taken using the camera.

Subsequently, the film F is taken out of the camera and developed to allow the respective light-sensitive layers to form color with different spectral absorption waveforms.

The film F, on which the taken image of the subject has been recorded by such color formation of the light-sensitive layers, is mounted on the carrier 40 in the scanner 12 of the image processing apparatus 10 and retained in a specified reading position.

Then, the light source 32 in the carrier 12 is turned on so that the scanner 12 starts entering (reading) the taken images on the film F.

In the scanner 12, light issued from the light source 32 has its quantity adjusted by the variable diaphragm 34 and is passed through a certain color filter, say, color filter 36R in the color filter disc 36 to undergo color adjustment and is subsequently diffused in the diffuser box 38 to form reading light. The reading light is incident on one frame of the film F as it is retained in the specified reading position by the carrier 40 and then transmitted through the film F to form projection light carrying the image taken in the frame of the film F. The projection light is focused by the imaging lens unit 42 on the light-receiving face of the area CCD sensor 44 to project the image thereon, so that the area CCD sensor 44 reads R color image data (color information) photoelectrically on a pixel-by-pixel basis.

Subsequently, the color filter disc 36 is rotated and the color filter 36R is switched over to the color filters 36G, 36B and 36IR in that order and the above-described reading process is repeated three times, whereby three kinds of color information for three colors G, B and IR, respectively, are read.

That is how the scanner 12 picks up four kinds of color information for colors R, G, B and IR from the film F.

If the film F has a magnetic layer on the side where no emulsion coatings are provided, information about film type is read from the magnetic layer by means of the magnetic information reading units 50 in the scanner 12.

The four kinds of color information (image data) thus picked up for the colors R, G, B and IR from the film F are transferred from the scanner 12 to the image converting portion 20 of the image processing section 14. If the type of the film F has also been read, it is sent from the scanner 12 to the spectral sensitivity input portion 22.

In the spectral sensitivity input portion 22, the spectral sensitivity waveforms associated with the type of the film F being used are chosen and the information about the chosen spectral sensitivity waveforms are transferred to the image converting portion 20.

Thereafter, in the image converting portion 20, the four kinds of color information (image data) from the film F for the colors R, G, B and IR that have been transferred from the scanner 12 are subjected to color transformation (image processing) based on the spectral sensitivity waveforms if they have been sent from the spectral sensitivity input portion 22.

For example, in the image converting portion 20, the four kinds of digital image data (color information) from the film F for the colors R, G, B and IR that have been transferred from the scanner 12 are converted to optical densities B, G, R and IR for each pixel.

In the next step, the obtained optical densities (B, G, R, IR) are converted to analytical densities (B', G', R', IR') by the already mentioned equation (7) using the 4×4 matrix MTXA represented by the already mentioned equation (6).

Subsequently, the obtained analytical densities (B', G', R', IR') are converted to amounts of exposure (r, g, b, ir) via a characteristic curve of the shape shown in FIG. 4.

In the last step, the amounts of exposure (r, g, b, ir) are converted to tristimulus values XYZ in the XYZ colorimetric system by the above mentioned equation (9) using the 3×4 matrix represented by the above mentioned equation (8).

The tristimulus values XYZ in the XYZ colorimetric system thus determined in the image converting portion 20 are supplied as three kinds of image data for print output to the digital printer 26 either as such or after being optionally subjected to further image processing; the digital printer 26 then outputs a photographic print P having an image that reproduces the supplied three kinds of image data for print output.

If desired, the tristimulus values XYZ as determined in the image converting portion 20 may be converted to the image data associated with the chosen output format and supplied either to the display 16 for representing the reproduced image or to the driver 28 which records the image data for the output image on a data recording medium M and outputs the data recording medium M; in yet another case, the image data for the output image may be distributed from the communication section 30 via a communication network like the Internet.

Described above are the basic structural features of the image processing method according to the second aspect of the invention.

EXAMPLE

The following examples are provided for further illustrating the present invention but are in no way to be taken as limiting.

Example 1

Figure 5A:
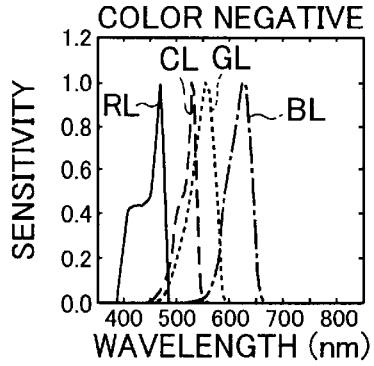
FIG. 5A is a graph showing the spectral sensitivity waveforms of the color light-sensitive material used in Example 1 of the invention.
Figure 5B:
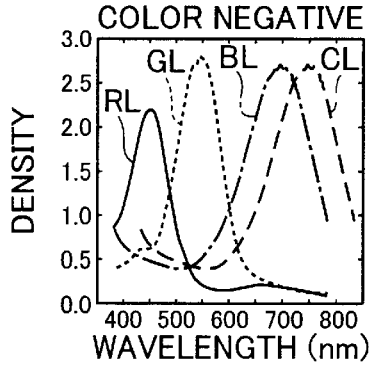
FIG. 5B is a graph showing the spectral absorption waveforms of the color light-sensitive material illustrated in FIG. 5A.

A sample of color negative film having the spectral sensitivities and color materials depicted in FIGS. 5A and SB was prepared as an example of the color light-sensitive material according to the first aspect of the invention.

1) Base

The base to be used in Example 1 was prepared by the following method.

1) First Layer and Undercoat

A polyethylene naphthalate (PEN) base 90 μm thick was subjected to glow discharge treatment on both sides with the treating atmosphere having a pressure of 2.66×10 Pa and the atmosphere gas having a $H_2O$ partial pressure of 75% under the following conditions: discharge frequency, 30 kHz; output, 2500 W; treatment intensity, 0.5 kV·A·min/m$^2$. To form a first layer, a coating solution of the following recipe was applied to the base in a coating weight of 5 mL/m$^2$ by the bar coating method described in JP 58-4589 B.

| | |
|---|---|
| Dispersion of conductive fine particles (aqueous dispersion with $SnO_2/Sb_2O_5$ particle conc. of 10%; primary particles with size of 0.005 μm formed secondary aggregates with average size of 0.05 μm) | 50 parts by mass |
| Gelatin | 0.5 parts by mass |
| Water | 49 parts by mass |
| Polyglycerol polyglycidyl ether | 0.16 parts by mass |
| Poly(pol. deg. 20)oxyethylene sorbitan monolaurate | 0.1 part by mass |

After coating the first layer, the base was wrapped onto a stainless steel roll with a diameter of 20 cm and heat treated at 110° C. (Tg of PEN base: 119° C.) for 48 hours to give sufficient thermal history for annealing; then, in order to form an undercoat for emulsions, a coating solution of the following recipe was applied to the other side of the base away from the first layer in a coating weight of 10 mL/m$^2$ by the bar coating method.

| | |
|---|---|
| Gelatin | 1.01 parts by mass |
| Salicylic acid | 0.30 parts by mass |
| Resorcin | 0.40 parts by mass |
| Poly(pol. deg. 10)oxyethylene nonyl phenyl ether | 0.11 parts by mass |
| Water | 3.53 parts by mass |
| Methanol | 84.57 parts by mass |
| n-Propanol | 10.08 parts by mass |

Further, a second and a third layer to be described below were sequentially coated on the first layer and, finally, a color negative light-sensitive material of the recipe set forth later was applied in superposition on the opposite side to thereby prepare a clear magnetic recording medium having silver halide emulsion layers.

2) Second Layer (Clear Magnetic Recording Layer)

(i) Dispersing Magnetic Particles

To 1100 parts by mass of Co-doped γ-$Fe_2O_3$ magnetic particles (av. major axis, 0.25 μm; $S_{BET}$, 39 m$^2$/g; Hc, 6.56×10$^4$ A/m; σs, 77.1 Am$^2$/kg; σr, 37.4 Am$^2$/kg), 220 parts by mass of water and 165 parts by mass of a silane coupling agent [3-(poly(pol. deg. 10)oxyethynyl)oxypropyl trimethoxysilane] were added and kneaded well in an open kneader for 3 hours. The resulting viscous crude dispersion was dried at 70° C. for 24 hours to remove water and thereafter heat treated at 110° C. for 1 hour to prepare surface-treated magnetic particles.

The magnetic particles were further kneaded in an open kneader for 4 hours according to the following recipe.

| | |
|---|---|
| Surface-treated magnetic particles | 855 g |
| Diacetyl cellulose | 25.3 g |
| Methyl ethyl ketone | 136.3 g |
| Cyclohexanone | 136.3 g |

Further, according to the following recipe, comminuting was done in a sand mill (1/4G sand mill) at 2000 rpm for 4 hours to give a dispersion of fine particles. The media were glass beads of 1 mm$^{\Phi}$.

| | |
|---|---|
| Solution of kneaded mixture | 45 g |
| Diacetyl cellulose | 23.7 g |
| Methyl ethyl ketone | 127.7 g |
| cyclohexanone | 127.7 g |

Still further, a magnetic medium containing intermediate liquor was prepared according to the following recipe.

(ii) Preparation of Magnetic Medium Containing Intermediate liquor

| | |
|---|---|
| Dispersion of fine magnetic particles | 674 g |
| Diacetyl cellulose solution (solids cont., 4.34%; solvents, methyl ethyl ketone/cyclohexanone = 1/1) | 24280 g |
| Cyclohexanone | 46 g |

These ingredients were agitated with a disperser to prepare the "magnetic medium containing intermediate liquor".

Dispersion of α-alumina abrasive to be used in the invention was prepared according to the following recipe.

(a) Preparing a Dispersion of Sumicorundum AA-1.5 Particles (av. primary particle size, 1.5 μm; specific surface area, 1.3 m$^2$/g)

| | |
|---|---|
| Sumicorundum AA-1.5 | 152 g |
| Silane coupling agent KBN 903 (product of Shin-Etsu Silicone Co., Ltd.) | 0.48 g |
| Diacetyl cellulosse solution (solids cont., 4.5%; solvents, methyl ethyl ketone/cyclohexanone = 1/1) | 227.52 g |

According to this recipe, comminuting was done in a ceramic coated sand mill (1/4G sand mill) at 800 rpm for 4 hours to give a dispersion of fine abrasive grains. The media were zirconia beads of 1 mm$^{\Phi}$.

(b) Dispersion of Colloidal Silica Particles (Fine Grains)

MEK-ST of Nissan Chemical Industries, Ltd. was used. This is a dispersion of colloidal silica particles (av. primary grain size, 0.015 μm) using methyl ethyl ketone as a dispersion medium; it had a solids content of 30%.

(iii) Preparation of Coating Solution for the Second Layer

| | |
|---|---|
| Magnetic medium containing intermediate liquor | 19053 g |
| Diacetyl cellulose solution (solids cont., 4.5%; solvents, methyl ethyl ketone/cyclohexanone = 1/1) | 264 g |
| Colloidal silica dispersion MEK-ST [dispersion (b)] (solids cont., 30%) | 128 g |
| AA-1.5 dispersion [dispersion (a)] | 12 g |
| MILIONATE MR-400 (product of Nippon Polyurethane Industry Co., Ltd.) dilution (solids cont., 20%; diluting solvents, methyl ethyl ketone/cyclohexanone = 1/1) | 203 g |
| Methyl ethyl ketone | 170 g |
| Cyclohexanone | 170 g |

These ingredients were mixed under agitation to prepare a coating solution which was applied with a wire bar in a coating weight of 29.3 mL/m$^2$. The applied coating was dried at 110° C. The dried magnetic layer had a thickness of 1.0 $\mu$m.

3) Third layer (Containing Higher Aliphatic Acid Ester Based Slip Agent)

(i) Preparing Concentrated Dispersion of Slip Agent

Solution A indicated below was heated at 100° C. and added to solution B and the mixture was dispersed with a high-pressure homogenizer to prepare a concentrated dispersion of slip agent.

| | |
|---|---|
| Solution A | |
| Compound (see below) $C_6H_{13}CH(OH)(CH_2)_{10}COOC_{50}H_{101}$ | 399 parts by mass |
| Compound (see below) n-$C_{50}H_{101}O(CH_2CH_2O)_{16}H$ | 171 parts by mass |
| Cyclohexanone | 830 parts by mass |
| Solution B | |
| Cyclohexanone | 8600 parts by mass |

(ii) Preparing Dispersion of Spherical Inorganic Particles

A dispersion of spherical inorganic particles [c1] was prepared according to the following recipe.

| | |
|---|---|
| Isopropyl alcohol | 93.54 parts by mass |
| Silane coupling agent KBM 903 (product of Shin-Etsu Silicone Co., Ltd.) | |
| Compound 1-1: $(CH_3O)_3Si—(CH_2)_3—NH_2$ | 5.53 parts by mass |
| Compound 1 | 2.93 parts by mass |
| Compound 1 | |

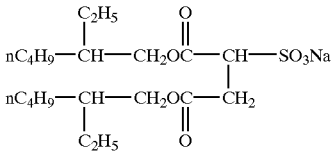

| | |
|---|---|
| SEEHOSTER KEP50 (amorphous spherical silica particles with av. grain size of 0.5 $\mu$m; product of NIPPON SHOKUBAI Co., LTD.) | 88.00 parts by mass |
| After stirring these ingredients for 10 minutes, the following was added. | |
| Diacetone alcohol | 252.93 parts by mass |

The resulting solution was put into an ultrasonic homogenizer SONIFIER 450 (product of BRANSON Co., Ltd.) and dispersed for 3 hours under cooling with ice and agitation to complete a dispersion of spherical inorganic particles [c1].

(iii) Preparing Dispersion of Spherical Organic Polymer Particles

A dispersion of spherical organic polymer particles [c2] was prepared according to the following recipe.

XC99-A8808 (product of Toshiba Silicone Co., Ltd.;

| | |
|---|---|
| spherical crosslinked polysiloxane particles with av. grain size of 0.9 $\mu$m) | 60 parts by mass |
| Methyl ethyl ketone | 120 parts by mass |
| Cyclohexanone (solids cont., 20%; solvents, methyl ethyl ketone/cyclohexanone = 1/1) | 120 parts by mass |

These ingredients were put into an ultrasonic homogenizer SONIFIER 450 (product of BRANSON Co., Ltd.) and dispersed for 2 hours under cooling with ice and agitation to complete a dispersion of spherical organic polymer particles [c2].

(iv) Preparation of Coating Solution for the Third Layer

To 542 g of the concentrated dispersion of slip agent, the following ingredients were added to make a coating solution for the third layer.

| | |
|---|---|
| Diacetone alcohol | 5950 g |
| Cyclohexanone | 176 g |
| Ethyl acetate | 1700 g |
| SEEHOSTER KEP50 dispersion [c1] | 53.1 g |
| Spherical organic polymer particle dispersion [c2] | 300 g |
| FC431 (product of 3M Co., Ltd.; solids cont., 50%; solvent, ethyl acetate) | 2.65 g |
| BYK 310 (product of BYK Chemi Japan Co., Ltd.; solids cont., 25%) | 5.3 g |

The thus prepared coating solution for the third layer was applied over the second layer in a coating weight of 10.35 mL/m$^2$; the applied coating was dried at 110° C. and further dried at 97° C. for 3 minutes.

4) Applying Light-sensitive Layers

In the next step, various light-sensitive layers of the following recipes were applied in superposition on the side of the PEN base which was opposite the side where the backing layer was provided, thereby preparing a color negative film. (Recipes of light-sensitive layers)

Numerals accompanying the ingredients listed below represent coating amounts in grams per square meter, which are calculated for silver if the ingredients are silver halides (in the following description, specific compounds are designated by symbols followed by a dash and a numeral and are later represented by chemical formulas).

| First layer (first anti-halation layer) | | |
|---|---|---|
| Black colloidal silver | silver | 0.122 |
| Silver iodobromide emulsion (0.07 $\mu$m) | silver | 0.01 |
| Gelatin | | 0.919 |
| Cpd-2 | | 0.001 |
| F-8 | | 0.001 |
| HBS-1 | | 0.050 |
| HBS-2 | | 0.002 |

-continued

| | | |
|---|---|---|
| Second layer (second anti-halation layer) | | |
| Black colloidal silver | silver | 0.055 |
| Gelatin | | 0.425 |
| ExF-1 | | 0.002 |
| F-8 | | 0.001 |
| Solid disperse dye ExF-7 | | 0.120 |
| HBS-1 | | 0.074 |
| Third layer (intermediate layer) | | |
| Cpd-1 | | 0.090 |
| Poly(ethyl acrylate) latex | | 0.200 |
| HBS-1 | | 0.100 |
| Gelatin | | 0.700 |
| Fourth layer (red-sensitive emulsion layer of low sensitivity) | | |
| Em-D | silver | 0.590 |
| Em-C | silver | 0.347 |
| ExC-1 | | 0.198 |
| ExC-3 | | 0.080 |
| EXC-4 | | 0.131 |
| ExC-8 | | 0.050 |
| ExC-9 | | 0.020 |
| Cpd-2 | | 0.025 |
| Cpd-4 | | 0.025 |
| UV-2 | | 0.047 |
| UV-3 | | 0.086 |
| UV-4 | | 0.018 |
| HBS-1 | | 0.245 |
| HBS-5 | | 0.038 |
| Gelatin | | 0.994 |
| Fifth layer (red-sensitive emulsion layer of medium sensitivity) | | |
| Em-B | silver | 0.450 |
| Em-C | silver | 0.432 |
| ExC-1 | | 0.174 |
| ExC-3 | | 0.028 |
| ExC-4 | | 0.123 |
| ExC-8 | | 0.016 |
| ExC-9 | | 0.005 |
| Cpd-2 | | 0.036 |
| Cpd-4 | | 0.028 |
| HBS-1 | | 0.129 |
| Gelatin | | 0.882 |
| Sixth layer (red-sensitive emulsion layer of high sensitivity) | | |
| Em-A | silver | 1.100 |
| ExC-1 | | 0.205 |
| ExC-3 | | 0.045 |
| ExC-8 | | 0.020 |
| Cpd-2 | | 0.064 |
| Cpd-4 | | 0.077 |
| HBS-1 | | 0.329 |
| HBS-2 | | 0.120 |
| Gelatin | | 1.245 |
| Seventh layer (intermediate layer) | | |
| Cpd-1 | | 0.094 |
| Cpd-6 | | 0.369 |
| Solid disperse dye ExF-4 | | 0.030 |
| HBS-1 | | 0.049 |
| Poly(ethyl acrylate) latex | | 0.088 |
| Gelatin | | 0.886 |
| Eighth layer (cyan sensitive layer) | | |
| Em-J | silver | 0.160 |
| Em-K | silver | 0.140 |
| Cpd-4 | | 0.030 |
| ExM-2 | | 0.130 |
| ExM-4 | | 0.026 |
| Infrared coupler (9) | | 0.080 |
| HBS-1 | | 0.218 |
| HBS-3 | | 0.003 |
| HBS-5 | | 0.030 |
| Gelatin | | 0.610 |
| Ninth layer (green-sensitive emulsion layer of low sensitivity) | | |
| Em-H | silver | 0.350 |
| Em-G | silver | 0.310 |
| Em-I | silver | 0.088 |
| ExM-2 | | 0.420 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| Tenth layer (green-sensitive emulsion layer of medium sensitivity) | | |
| Em-F | silver | 0.420 |
| ExM-2 | | 0.060 |
| ExM-4 | | 0.029 |
| ExC-8 | | 0.010 |
| HBS-1 | | 0.065 |
| HBS- | | 0.002 |
| HBS-4 | | 0.020 |
| HBS-5 | | 0.020 |
| Cpd-5 | | 0.004 |
| Gelatin | | 0.446 |
| Eleventh layer (green-sensitive emulsion layer of high sensitivity) | | |
| Em-E | silver | 0.801 |
| ExC-8 | | 0.010 |
| ExM-2 | | 0.055 |
| ExM-4 | | 0.017 |
| Cpd-3 | | 0.004 |
| Cpd-4 | | 0.007 |
| Cpd-5 | | 0.010 |
| HBS-1 | | 0.148 |
| HBS-3 | | 0.003 |
| HBS-4 | | 0.020 |
| HBS-5 | | 0.037 |
| Poly(ethyl acrylate) latex | | 0.099 |
| Gelatin | | 0.939 |
| Twelfth layer (yellow filter layer) | | |
| Cpd-1 | | 0.094 |
| Solid disperse dye ExF-2 | | 0.070 |
| Solid disperse dye ExF-5 | | 0.010 |
| Oil-soluble dye ExF-6 | | 0.010 |
| HBS-1 | | 0.049 |
| Gelatin | | 0.630 |
| Thirteenth layer (blue-sensitive emulsion layer of low sensitivity) | | |
| Em-O | silver | 0.130 |
| Em-M | silver | 0.330 |
| Em-N | silver | 0.280 |
| ExY-2 | | 0.940 |
| Cpd-2 | | 0.100 |
| Cpd-3 | | 0.004 |
| HBS-1 | | 0.222 |
| HBS-5 | | 0.074 |
| Gelatin | | 1.553 |
| Fourteenth layer (blue-sensitive emulsion layer of high sensitivity) | | |
| Em-L | silver | 0.690 |
| ExY-2 | | 0.280 |
| Cpd-2 | | 0.075 |
| Cpd-3 | | 0.001 |
| HBS-1 | | 0.124 |
| Gelatin | | 0.678 |
| Fifteenth layer (first protective layer) | | |
| Silver iodobromide emulsion (0.07 μm) | silver | 0.301 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |

-continued

| | |
|---|---|
| HBS-1 | 0.175 |
| HBS-4 | 0.050 |
| Gelatin | 1.984 |
| Sixteenth layer (second protective layer) | |
| H-1 | 0.400 |
| B-1 (dia. 1.7 μm) | 0.050 |
| B-2 (dia. 1.7 μm) | 0.150 |
| B-3 | 0.050 |
| S-1 | 0.200 |
| Gelatin | 0.750 |

The individual layers also contained W-1 to W-6, B-4 to B-6, F-1 to F-17, as well as a lead salt, a platinum salt, an iridium salt and a rhodium salt as appropriate in order to provide better keeping quality, processability, pressure resistance, mildew-proof and sterile properties, anti-static property and applicability.

Preparing Dispersion of Organic Solid Disperse Dye

ExF-2 in the 12th layer was dispersed by the following method.

| | |
|---|---|
| Wet cake of Exf-2 (containing 17.6 wt % $H_2O$ | 2.800 kg |
| Octylphenyldiethoxymethanesulfonic acid sodium salt (31 wt % aq. sol.) | 0.376 kg |
| F-15 (7% aq. sol.) | 0.011 kg |
| Water | 4.020 kg |
| To make (adjusted to pH = 7.2 with NaOH) | 7.210 kg |

A slurry of this recipe was agitated with a dissolver to make a coarse dispersion which was then put into an agitator mill LMK-4 and dispersed at a peripheral speed of 10 m/s and at a discharge rate of 0.6 kg/min with 80% loading of zirconia beads (0.3 $mm^{\Phi}$) until the dispersion had an absorbance ratio of 0.29, whereupon a dispersion of fine solid particles was obtained. The fine dye particles had an average grain size of 0.29 μm.

The same procedure was taken to prepare solid dispersions of ExF-4 and ExF-7, in which the fine dye particles had average grain sizes of 0.28 μm and 0.49 μm, respectively. ExF-5 was dispersed by the method of microprecipitation described in Example 1 in European Patent No. 549,489A. The average grain size was 0.06 μm.

TABLE 4

| Emulsion | Average iodide content (mol %) | Diameter of equivalent sphere (μm) | Aspect ratio | Diameter of equivalent circle (μm) | Grain thickness (μm) | Morphology |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

In Table 4, emulsions A-C had spectral sensitizing dyes 1–3 added in optimum amounts for optimum gold, sulfur and selenium sensitization; emulsions E-G had spectral sensitizing dyes 4–6 added in optimum amounts for optimum gold, sulfur and selenium sensitization; emulsion J had spectral sensitizing dyes 7 and 8 added in optimum amounts for optimum gold, sulfur and selenium sensitization; emulsion L had spectral sensitizing dyes 9–11 added in optimum amounts for optimum gold, sulfur and selenium sensitization; emulsion O had spectral sensitizing dyes 10–12 added in optimum amounts for optimum gold and sulfur sensitization; emulsions D, H, I, K, M and N had the following spectral sensitizing dyes (see Table 5 below) added in optimum amounts for optimum gold, sulfur and selenium sensitization.

TABLE 5

| Emulsion | Sensitizing dyes | Amount (mol/mol silver) |
|---|---|---|
| Em-D | sensitizing dye 1 | $5.44 \times 10^{-4}$ |
| | sensitizing dye 2 | $2.35 \times 10^{-4}$ |
| | sensitizing dye 3 | $7.26 \times 10^{-6}$ |
| Em-H | sensitizing dye 8 | $6.52 \times 10^{-4}$ |
| | sensitizing dye 13 | $1.35 \times 10^{-4}$ |
| | sensitizing dye 6 | $2.48 \times 10^{-5}$ |
| Em-I | sensitizing dye 8 | $6.09 \times 10^{-4}$ |
| | sensitizing dye 13 | $1.26 \times 10^{-4}$ |
| | sensitizing dye 6 | $2.32 \times 10^{-5}$ |
| Em-K | sensitizing dye 7 | $6.27 \times 10^{-4}$ |
| | sensitizing dye 8 | $2.24 \times 10^{-4}$ |
| Em-M | sensitizing dye 9 | $2.43 \times 10^{-4}$ |
| | sensitizing dye 10 | $2.43 \times 10^{-4}$ |
| | sensitizing dye 11 | $2.43 \times 10^{-4}$ |
| Em-N | sensitizing dye 9 | $3.28 \times 10^{-4}$ |
| | sensitizing dye 10 | $3.28 \times 10^{-4}$ |
| | sensitizing dye 11 | $3.28 \times 10^{-4}$ |

The chemical formulas of the sensitizing dyes listed in Table 5 are shown below.

Sensitizing dye 1

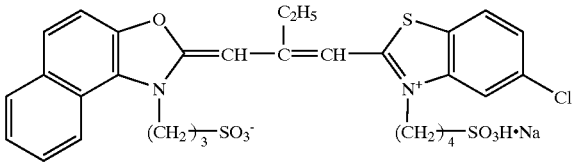

Sensitizing dye 2

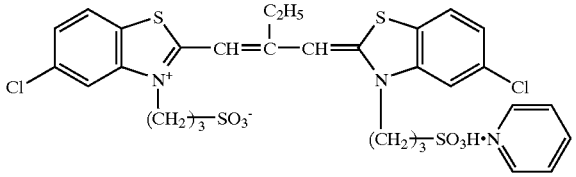

-continued

Sensitizing dye 3

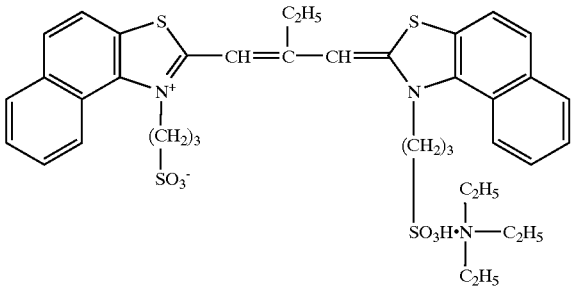

Sensitizing dye 4

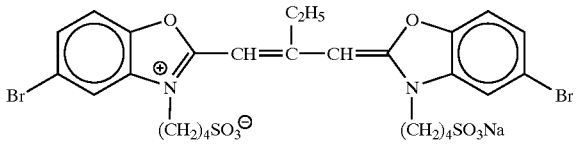

Sensitizing dye 5

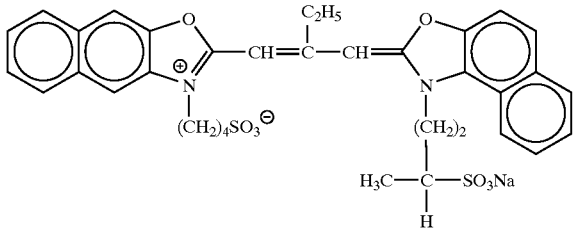

Sensitizing dye 6

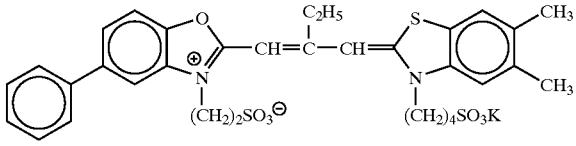

Sensitizing dye 7

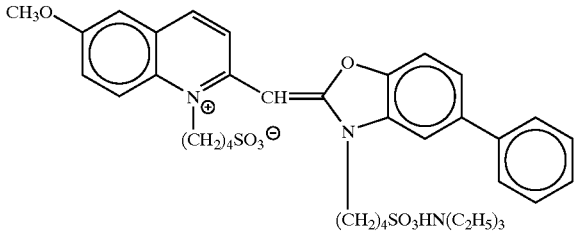

Sensitizing dye 8

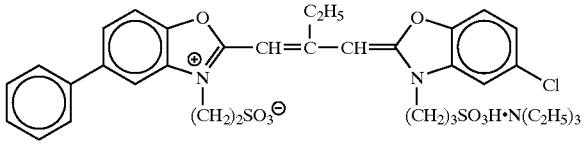

Sensitizing dye 9

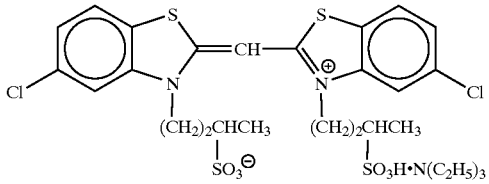

-continued

Sensitizing dye 10

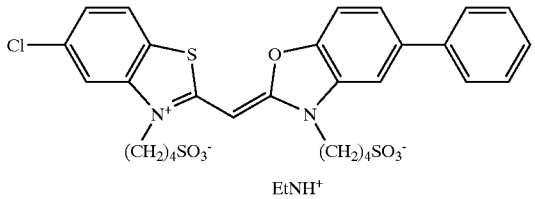

Sensitizing dye 11

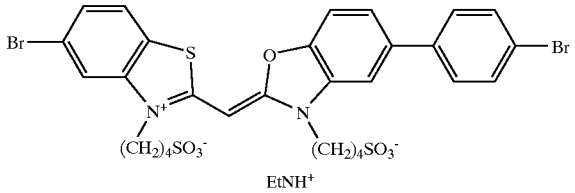

Sensitizing dye 12

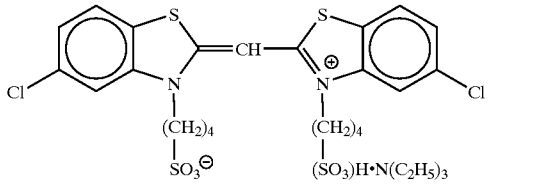

Sensitizing dye 13

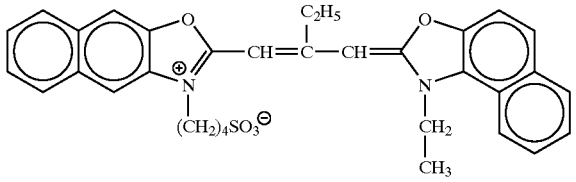

For preparation of tabular grains, low-molecular weight gelatin was used in accordance with Examples described in JP 1-158426 A.

Emulsions A-K contained Ir and Fe in optimum amounts.

Emulsions L-O were reduction sensitized during grain preparation.

Upon examination with a high-voltage electron microscope, the tabular grains were found to have dislocation lines of the type described in JP 3-237450 A.

Emulsions A-C and J had dislocations introduced using an iodide ion releaser according to Examples described in JP 6-11782 A.

Emulsion E had dislocations introduced using fine silver iodide grains prepared just before addition in a separate chamber equipped with a magnetic coupling induction stirrer of the type described in JP 10-43570 A.

The chemical formulas of the compounds used in the respective layers of the color negative film are shown below.

ExC-1
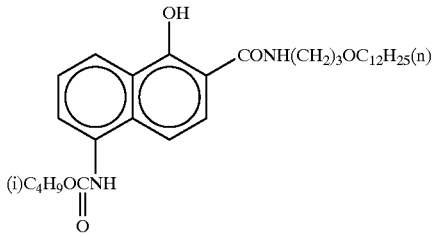
ExC-2
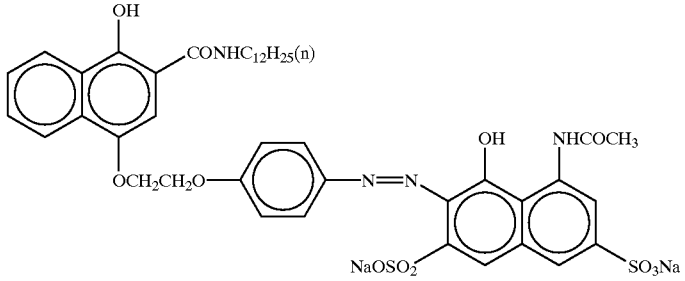
ExC-3
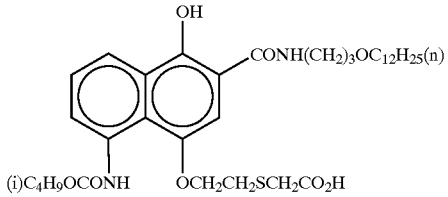
ExC-4
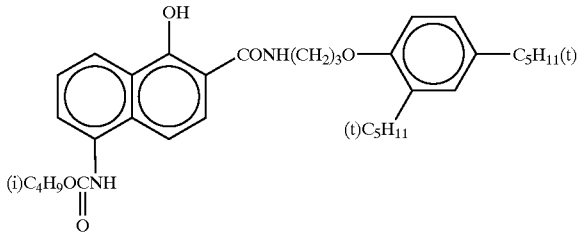
ExC-5
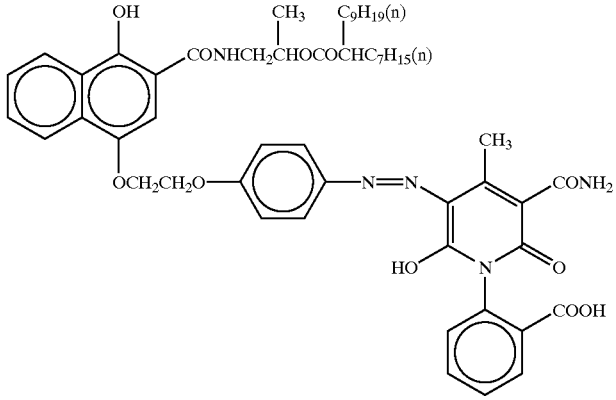

-continued
ExC-6
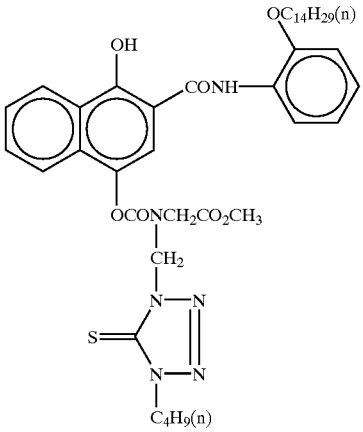
ExC-7
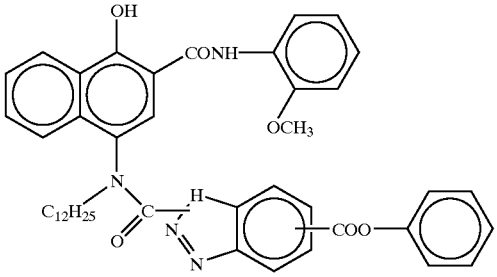
ExC-8
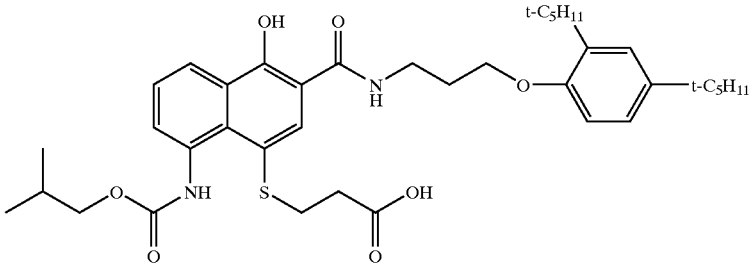
ExC-9
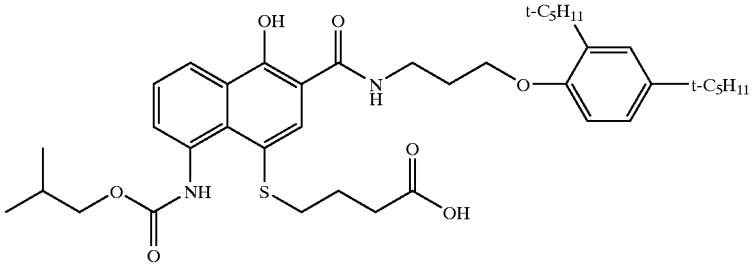

-continued
ExM-1
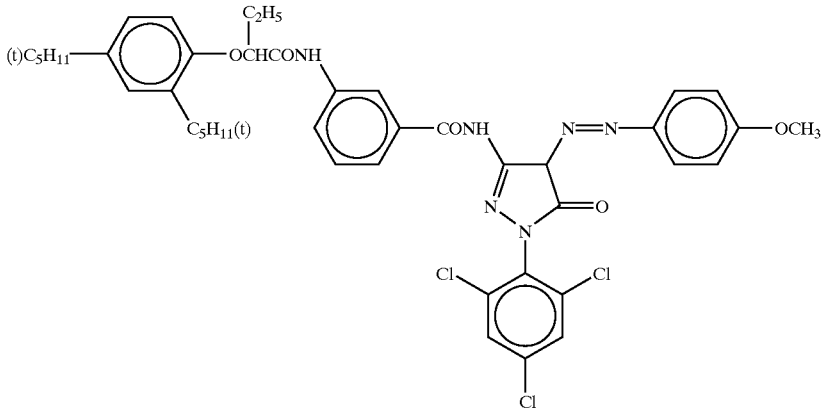
ExM-2
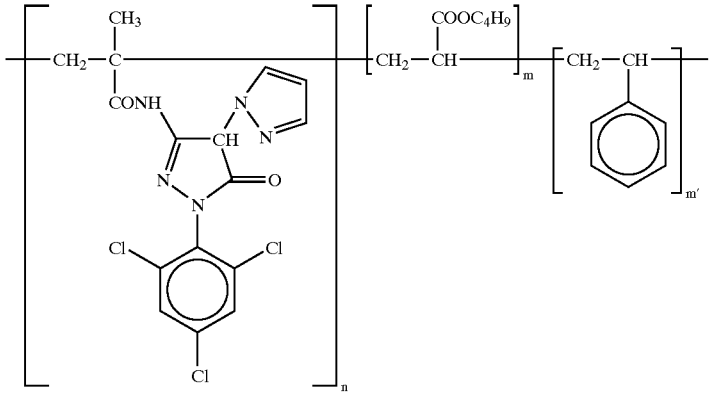
n = 50
m = 25
m′ = 25
mol. wt. ca. 20,000
ExM-3
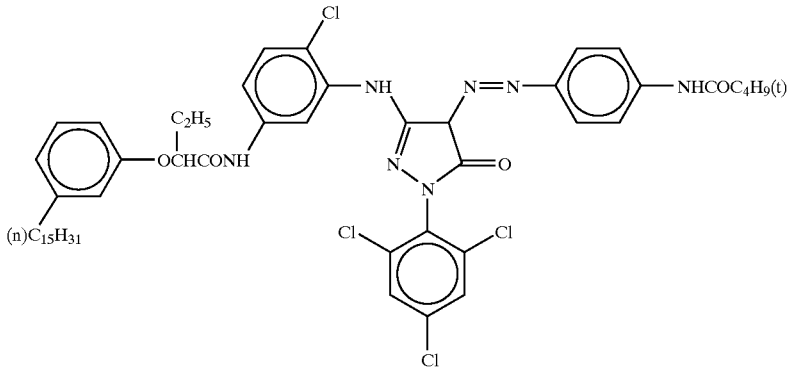
ExM-4
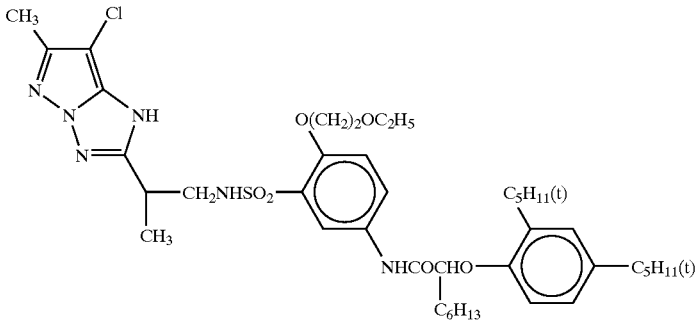

-continued
ExY-1
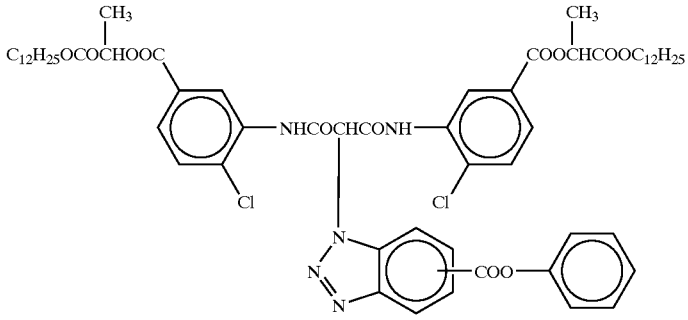
ExY-2
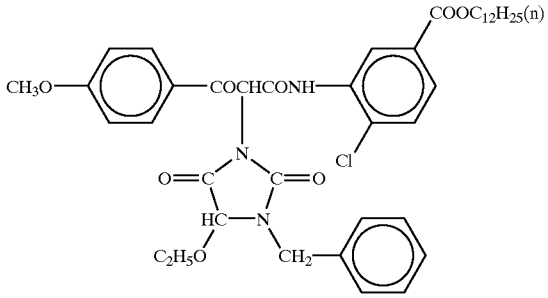
ExY-3
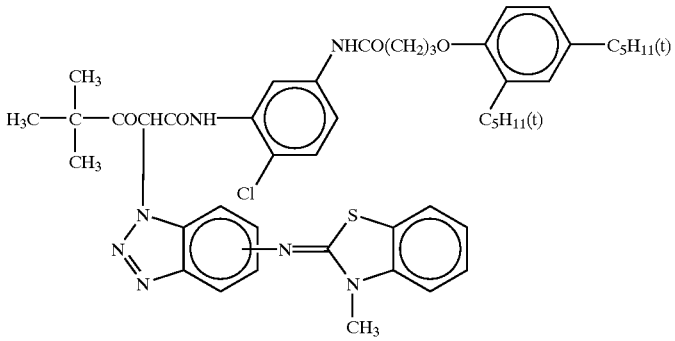
ExY-4
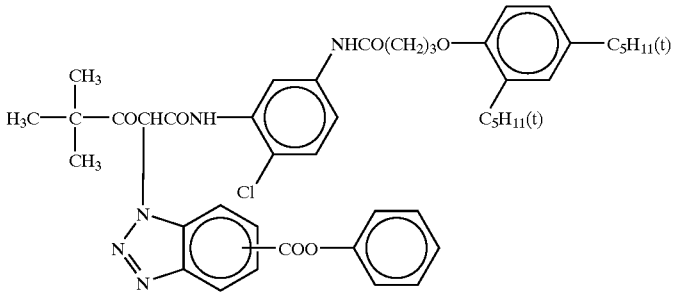
Cpd-1
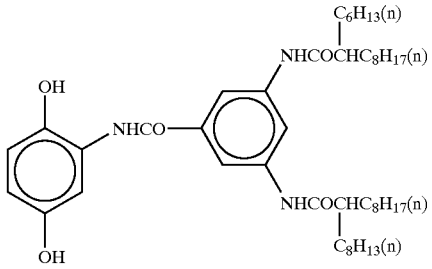

-continued
Cpd-2
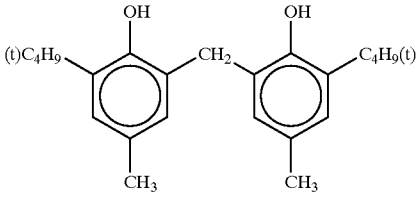
Cpd-3
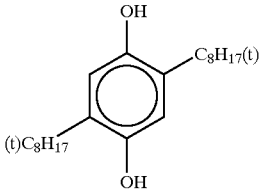
Cpd-4
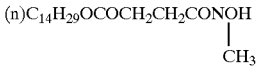
Cpd-5
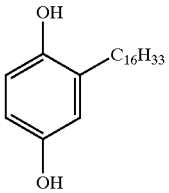
Cpd-6
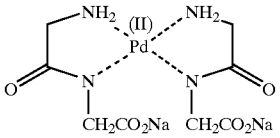
UV-1
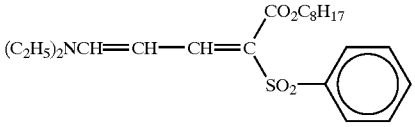
UV-2
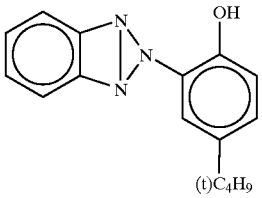
UV-3
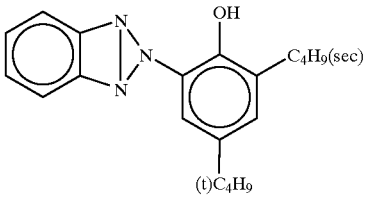
UV-4
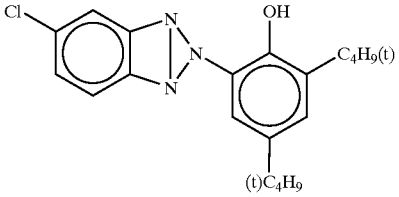

-continued
B-1
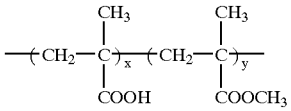
x/y = 10/90 (by weight)
Av. mol. wt. ca. 35,000
B-2
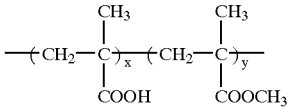
x/y = 40/60 (by weight)
Av. mol. wt. ca. 20,000
B-3
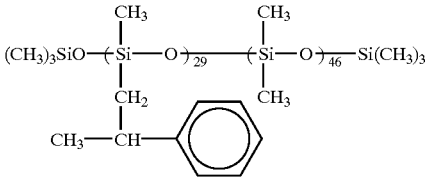
(by mole)
Av. mol. wt. ca. 8,000
HBS-1
Tricresyl/phosphate
HBS-2
Di-n-butyl/phthalate
HBS-3
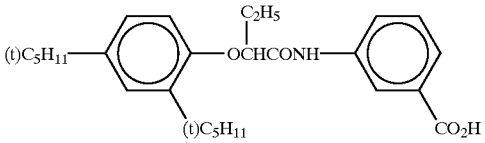
HBS-4
Tri(2-ethylhexyl)phosphate
HBS-5
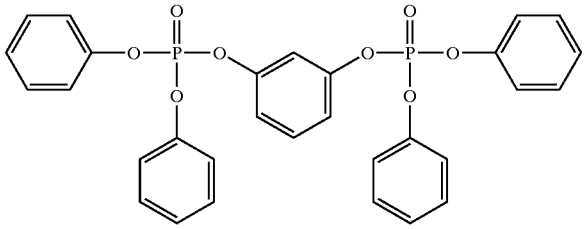
S-1
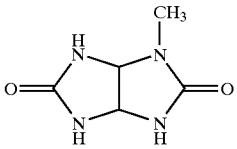
H-1
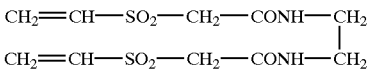
F-1
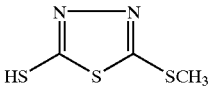

-continued
F-2
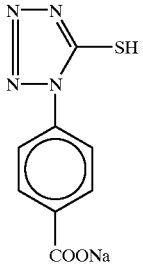
F-3
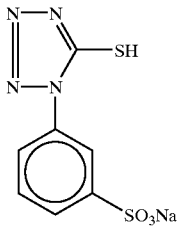
F-4
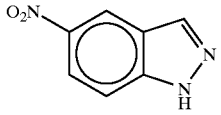
F-5
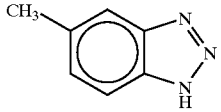
F-6
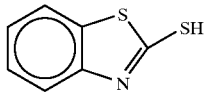
F-7
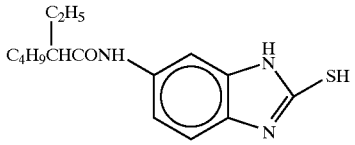
F-8
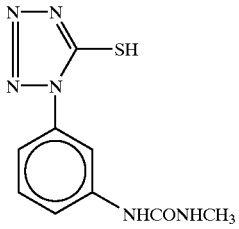
F-9
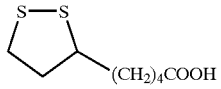
F-10
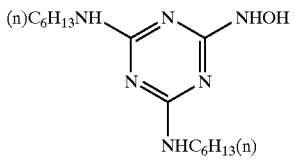

-continued
F-11
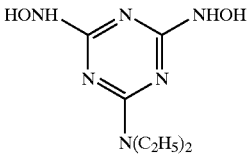
F-12
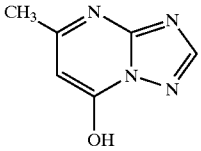
F-13
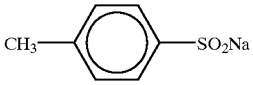
F-14
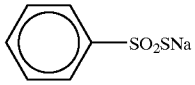
F-15
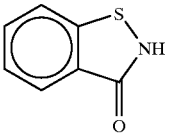
F-16
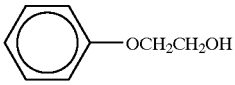
F-17
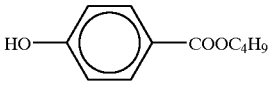
F-18
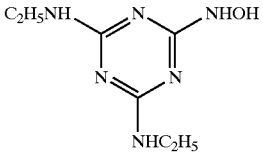
W-1
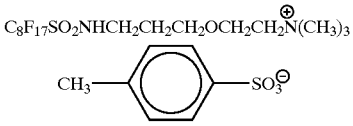
W-2
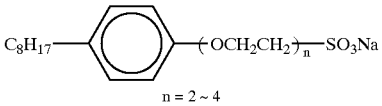
W-3
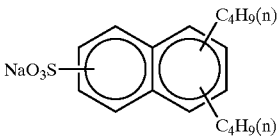
W-4
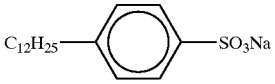

-continued
W-5
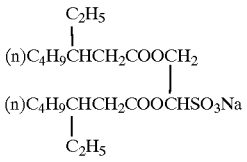
W-6
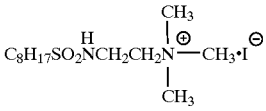
B-4
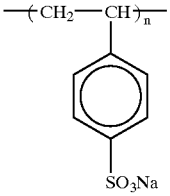
Av. mol. wt. ca. 750,000
B-5
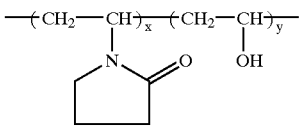
x/y = 70/30 (by weight)
Av. mol. wt. ca. 17,000
B-6
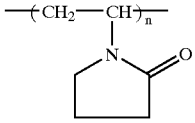
Av. mol. wt. ca. 10,000
ExF-1
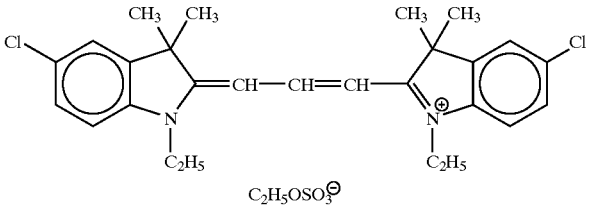
ExF-2
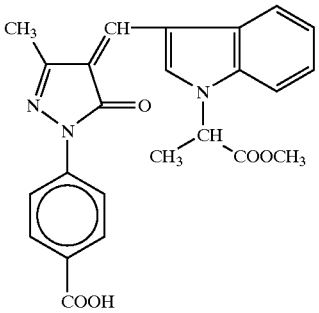

-continued

ExF-4

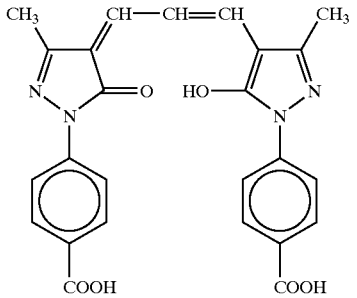

ExF-5

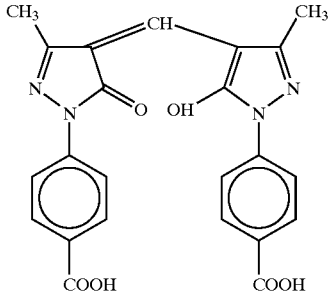

ExF-6

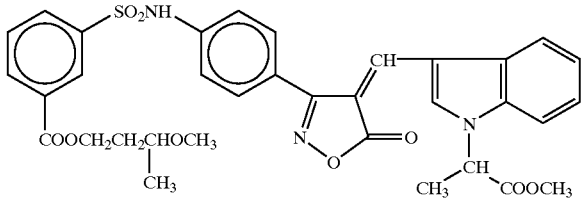

ExF-7

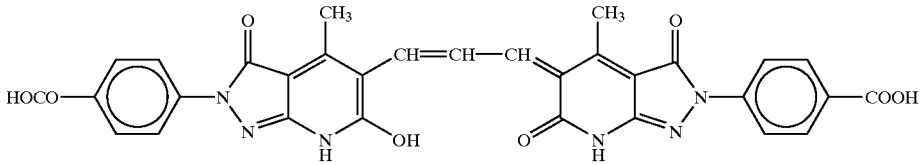

The thus prepared silver halide color photographic material (color negative film) was designated sample 101.

Sample 101 was exposed for 1/100 second through a gelatin filter SC-39 of Fuji Film and a continuous wedge.

Development was performed as follows using an automatic processor FP-360B of Fiji Film, provided that it was revamped to allow all of the overflow from the bleach bath to sink into the waste solution tank rather than into the subsequent bath. FP-360B was equipped with the evaporation compensation means described in JIII Journal of Technical Disclosure No. 94-4992.

The processing steps and the recipes of the respective processing solutions are shown below.

| Step | Time | Temperature | Amount of replenishment* | Tank capacity |
|---|---|---|---|---|
| (Processing steps) | | | | |
| Color development | 3 min & 5 sec | 37.8° C. | 20 mL | 11.5 L |
| Bleach | 50 sec | 38.0° C. | 5 mL | 5 L |
| Fix (1) | 50 sec | 38.0° C. | — | 5 L |

-continued

| Step | Time | Temperature | Amount of replenishment* | Tank capacity |
|---|---|---|---|---|
| Fix (2) | 50 sec | 38.0° C. | 8 mL | 5 L |
| Wash | 30 sec | 38.0° C. | 17 mL | 3 L |
| Stabilize (1) | 20 sec | 38.0° C. | — | 3 L |
| Stabilize (2) | 20 sec | 38.0° C. | 15 mL | 3 L |
| Dry | 1 min & 30 sec | 60.0° C. | | |

*The amount of replenishment is calculated for each 1.1 m length of 35-mm wide light-sensitive material (corresponding to a roll of 24-exposure 35-mm film).

The stabilizing solution and the fixing solution were allowed to flow in a countercurrent fashion from (2) to (1) and the overflow of the washing water was all introduced into the fix bath (2). The carryover of the developing solution into the bleach step, the carryover of the bleaching solution into the fix step and the carryover of the fixing solution into the wash step were 2.5 mL, 2.0 mL and 2.0 mL, respectively, per each 1.1 m length of 35-mm wide light-sensitive material. The crossover time was 6 seconds in each instance and included in the processing time in the preceding step.

The area of the opening in the processor was 100 $cm^2$ for the color developing solution, 120 $cm^2$ for the bleaching solution and about 100 $cm^2$ for other processing solutions.

The recipes of the respective processing solutions are shown below.

| | Tank solution (g) | Replenisher (g) |
|---|---|---|
| (Color developing solution) | | |
| Diethylenetriaminepentaacetic acid | 3.0 | 3.0 |
| Catechol-3,5-disulfonic acid disodium salt | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl) amino]aniline sulfate | 4.5 | 6.5 |
| Water to make | 1.0 L | 1.0 L |
| pH (adjusted with potassium hydroxide and sulfuric acid) | 10.05 | 10.18 |

[0169]

| | Tank solution (g) | Replenisher (g) |
|---|---|---|
| (Bleaching solution) | | |
| 1,3-Diaminopropanetetraacetic acid ferric ammonium monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH [adjusted with aqueous ammonia] | 4.6 | 4.0 |
| (Fixing (1) tank solution) | | |
| A mixture of the bleaching tank solution and the fixing tank solution (see below) at a volume ratio of 5:95 (pH 6.8). | | |
| (Fixing (2) solution) | | |
| Aq. sol. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1.0 L | 1.0 L |
| pH [adjusted with aqueous ammonia and acetic acid] | 7.4 | 7.45 |

Washing Water

Tap water was passed through a mixed-bed column packed with an H-form strong acetic acid cation-exchange resin (Amberlite IR-120B of Rohm and Haas) and an OH-form strong basic anion-exchange resin (Amberlite IR-400 of Rohm and Haas) to reduce the calcium and magnesium ion concentrations to 3 mg/L and below; thereafter, a sodium salt of isocyanuric acid dichloride (20 mg/L) and sodium sulfate (150 mg/L) were added. The resulting solution had a pH between 6.5 and 7.5.

| | Tank solution/ Replenisher (in grams) |
|---|---|
| (Stabilizing solution) | |
| p-Toluenesulfinic acid sodium | 0.03 |
| Polyoxyethylene-p-monononylphenyl ether (av. polymerization degree = 10) | 0.2 |
| 1,2-Benzoisothiazolin-3-one sodium | 0.10 |
| Ethylenediaminetetraacetic acid disodium salt | 0.05 |
| 1,2,4-Triazole | 1.3 |
| 1,4-Bis(1,2,4-triazol-1-ylmethyl)piperazine | 0.75 |
| Water to make | 1.0 L |
| pH | 8.5 |

Another sample of color negative film was prepared by repeating the procedure for the preparation of sample 101, except that the 8th layer was removed and the coating weights of the ingredients in the 10th layer were increased to 1.7 times the values for sample 101. The thus prepared sample was designated sample 102.

Just Like sample 101, Sample 102 was developed after 1/100 sec exposure through a gelatin filter SC-39 of Fuji Film and a continuous wedge.

Sample 101 was a case of the invention; it was a color light-sensitive material (color negative film) that had not only three R, G and B sensitive layers but also a cyan sensitive fourth layer containing an infrared coupler (i.e., 8th layer in sample 101) and which was caused to form color in the infrared region by means of the infrared coupler. Sample 102 was a comparative case; it was a color light-sensitive material (color negative film) that had three ordinary light-sensitive layers having RGB spectral sensitivities.

Figure 5C:
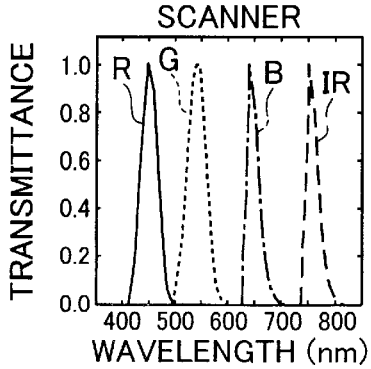
FIG. 5C is a graph showing exemplary spectral sensitivities for a scanner used to read the image on a color light-sensitive material having the spectral absorption waveforms shown in FIG. 5B.

After development, sample 101 of the invention was read with a 4-channel scanner built as a trial having the spectral sensitivities shown in FIG. 5C to pick up image information for the four colors R, G, B and IR; developed sample 102 was read with a 3-channel scanner also built as a trial to pick up image information for three colors R, G and B. The incorporated information was subjected to image processing and the two output images were compared for the fidelity of color reproduction.

To be more specific, developed sample 101 was read with the 4-channel scanner and respective colors were converted to optical densities (B, G, R and IR in order from the shorter wavelength side) on a pixel-by-pixel basis.

The thus obtained optical densities (B,G,R,IR) were converted to analytical densities (B',G',R',IR') through calculation by Eq. (7).

Then, the analytical densities (B',G',B',IR') were converted to amounts of exposure (r,g,b,ir) via the characteristic curve depicted in FIG. 4; through calculation by Eq. (9), the amounts of exposure (r,g,b,ir) were converted to tristimulus values XYZ in an XYZ calorimetric system and supplied to a digital printer (PICTROGRAPHY 3000 of Fuji Film) for outputting photographic prints.

After development, sample 102 was read with the 3-channel scanner and respective colors connected to it were converted to optical densities (B,G,R) on a pixel-by-pixel basis, which in turn were converted to analytical densities (B',G',R') by the following equation (10):

$$\begin{pmatrix} B' \\ G' \\ R' \end{pmatrix} = \begin{pmatrix} 1.00 & 0.07 & 0.04 \\ 0.07 & 1.00 & 0.09 \\ 0.16 & 0.06 & 1.00 \end{pmatrix}^{-1} \begin{pmatrix} B - 0.63 \\ G - 0.73 \\ R - 0.49 \end{pmatrix} \quad (10)$$

Then, the analytical densities (B',G',B') were converted to amounts of exposure (r,g,b) via the characteristic curve depicted in FIG. 4; through calculation by the following equation (11), the amounts of exposure (r,g,b) were converted to tristimulus values XYZ in an XYZ calorimetric system and supplied to the same digital printer (PICTROGRAPHY 3000 of Fuji Film) for outputting photographic prints.

$$\begin{pmatrix} X \\ Y \\ Z \end{pmatrix} = \begin{pmatrix} 053 & 0.29 & 0.18 \\ 0.30 & 0.63 & 0.07 \\ 0.03 & 0.06 & 0.90 \end{pmatrix} \begin{pmatrix} r \\ g \\ b \end{pmatrix} \quad (11)$$

The photographic prints obtained from sample 101 of the invention and those obtained from comparative sample 102 were visually compared for color reproduction and better results were obtained by the former.

The color reproduction in the two samples of color light-sensitive material was also evaluated in terms of FOM (FIGURE of merit as an index for the evaluation of spectral sensitivity). The results of comparison are shown below in Table 6 which reproduces the data given in the first and third rows of Table 3, provided that they are reversed in Table 6.

TABLE 6

| | Comparing the color reproduction in two samples | | |
|---|---|---|---|
| | FOM(y) | FOM(x-y) | FOM(y-z) |
| Sample 101 (invention) | 0.90 | 0.92 | 0.80 |
| Sample 102 (comparison) | 0.88 | 0.77 | 0.80 |

As is clear from Table 6, sample 101 of the invention was little different from comparative sample 102 in terms of FOM(y) and FOM(y-z) but it achieved an outstanding increase in FOM(x-y), indicating an improvement in the reproduction of red to green color. It is therefore clear that the design of the invention contributed a lot to improving the fidelity in color reproduction.

Example 2

Preparing Sample 201

Sample 201 was prepared by repeating the procedure for the preparation of sample 101, except that the recipes of light-sensitive layers were changed as follows. (Recipes of light-sensitive layers)

Numerals accompanying the ingredients listed below represent coating amounts in grams per square meter, which are calculated for silver if the ingredients are silver halides (in the following description, specific compounds are designated by symbols followed by a dash and a numeral; for their chemical formulas, see Example 1).

| | | |
|---|---|---|
| First layer (first anti-halation layer) | | |
| Black colloidal silver | silver | 0.110 |
| Silver iodobromide emulsion (0.07 μm) | silver | 0.01 |
| Gelatin | | 0.900 |
| ExM-1 | | 0.066 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |
| Second layer (second anti-halation layer) | | |
| Black colloidal silver | silver | 0.049 |
| Gelatin | | 0.435 |
| ExF-1 | | 0.002 |
| F-8 | | 0.001 |
| Solid disperse dye ExF-7 | | 0.120 |
| HBS-1 | | 0.074 |
| Third layer (intermediate layer) | | |
| ExC-2 | | 0.050 |
| Cpd-1 | | 0.090 |
| Poly(ethyl acrylate) latex | | 0.200 |
| HBS-1 | | 0.100 |
| Gelatin | | 0.700 |
| Fourth layer (red-sensitive emulsion layer of low sensitivity) | | |
| Em-D | silver | 0.560 |
| Em-C | silver | 0.330 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| ExC-8 | | 0.050 |
| ExC-9 | | 0.020 |
| Cpd-2 | | 0.025 |
| Cpd-4 | | 0.025 |
| UV-2 | | 0.047 |
| UV-3 | | 0.086 |
| UV-4 | | 0.018 |
| HBS-1 | | 0.245 |
| HBS-5 | | 0.038 |
| Gelatin | | 0.994 |
| Fifth layer (red-sensitive emulsion layer of medium sensitivity) | | |
| Em-B | silver | 0.470 |
| Em-C | silver | 0.450 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.028 |
| HBS-1 | | 0.129 |
| Gelatin | | 0.882 |
| Sixth layer (red-sensitive emulsion layer of high sensitivity) | | |
| Em-A | silver | 1.050 |
| ExC-1 | | 0.180 |
| ExC-3 | | 0.035 |
| ExC-6 | | 0.035 |
| ExC-8 | | 0.110 |
| ExC-9 | | 0.020 |
| Cpd-2 | | 0.064 |
| Cpd-4 | | 0.077 |
| HBS-1 | | 0.329 |
| HBS-2 | | 0.120 |
| Gelatin | | 1.245 |

-continued

| | | |
|---|---|---|
| Seventh layer (intermediate layer) | | |
| Cpd-1 | | 0.094 |
| Cpd-6 | | 0.369 |
| Solid disperse dye ExF-4 | | 0.030 |
| HBS-1 | | 0.049 |
| Poly(ethyl acrylate) latex | | 0.088 |
| Gelatin | | 0.886 |
| Eighth layer (layer imparting interimage effects to red-sensitive layers) | | |
| Em-J | silver | 0.170 |
| Em-K | silver | 0.140 |
| Cpd-4 | | 0.030 |
| ExM-2 | | 0.130 |
| ExM-3 | | 0.020 |
| ExM-4 | | 0.030 |
| ExY-1 | | 0.016 |
| ExY-4 | | 0.036 |
| ExC-7 | | 0.026 |
| HBS-1 | | 0.218 |
| HBS-3 | | 0.003 |
| HBS-5 | | 0.030 |
| Gelatin | | 0.610 |
| Ninth layer (green-sensitive emulsion layer of low sensitivity) | | |
| Em-H | silver | 0.310 |
| Em-G | silver | 0.300 |
| Em-I | silver | 0.090 |
| ExM-2 | | 0.395 |
| ExM-3 | | 0.047 |
| ExY-3 | | 0.025 |
| ExC-7 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| Tenth layer (green-sensitive emulsion layer of medium sensitivity) | | |
| Em-F | silver | 0.430 |
| ExM-2 | | 0.030 |
| ExM-3 | | 0.029 |
| ExM-4 | | 0.029 |
| ExY-3 | | 0.010 |
| ExC-6 | | 0.010 |
| ExC-7 | | 0.012 |
| ExC-8 | | 0.010 |
| HBS-1 | | 0.065 |
| HBS-3 | | 0.002 |
| HBS-4 | | 0.020 |
| HBS-5 | | 0.020 |
| Cpd-5 | | 0.004 |
| Gelatin | | 0.446 |
| Eleventh layer (green-sensitive emulsion layer of high sensitivity) | | |
| Em-E | silver | 0.720 |
| ExC-6 | | 0.004 |
| ExC-8 | | 0.010 |
| ExM-1 | | 0.013 |
| ExM-2 | | 0.015 |
| ExM-3 | | 0.030 |
| ExM-4 | | 0.017 |
| ExY-3 | | 0.003 |
| Cpd-3 | | 0.004 |
| Cpd-4 | | 0.007 |
| Cpd-5 | | 0.010 |
| HBS-1 | | 0.148 |
| HBS-3 | | 0.003 |
| HBS-4 | | 0.020 |
| HBS-5 | | 0.037 |
| Poly(ethyl acrylate) latex | | 0.099 |
| Gelatin | | 0.939 |

-continued

| | | |
|---|---|---|
| Twelfth layer (yellow filter layer) | | |
| Cpd-1 | | 0.094 |
| Solid disperse dye ExF-2 | | 0.070 |
| Solid disperse dye ExF-5 | | 0.010 |
| Oil-soluble dye ExF-6 | | 0.010 |
| HBS-1 | | 0.049 |
| Gelatin | | 0.630 |
| Thirteenth layer (blue-sensitive emulsion layer of low sensitivity) | | |
| Em-O | silver | 0.100 |
| Em-M | silver | 0.380 |
| Em-N | silver | 0.250 |
| ExC-1 | | 0.030 |
| ExC-7 | | 0.010 |
| ExY-1 | | 0.002 |
| ExY-2 | | 0.890 |
| ExY-4 | | 0.058 |
| Cpd-2 | | 0.100 |
| Cpd-3 | | 0.004 |
| HBS-1 | | 0.222 |
| HBS-5 | | 0.074 |
| Gelatin | | 1.553 |
| Fourteenth layer (blue-sensitive emulsion layer of high sensitivity) | | |
| Em-L | silver | 0.750 |
| ExY-2 | | 0.233 |
| ExY-4 | | 0.068 |
| Cpd-2 | | 0.075 |
| Cpd-3 | | 0.001 |
| HBS-1 | | 0.124 |
| Gelatin | | 0.678 |
| Fifteenth layer (first protective layer) | | |
| Silver iodobromide emulsion (0.07 μm) | silver | 0.301 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |
| HBS-1 | | 0.175 |
| HBS-4 | | 0.050 |
| Gelatin | | 1.984 |
| Sixteenth layer (second protective layer) | | |
| H-1 | | 0.400 |
| B-1 (dia. 1.7 μm) | | 0.050 |
| B-2 (dia. 1.7 μm) | | 0.150 |
| B-3 | | 0.050 |
| S-1 | | 0.200 |
| Gelatin | | 0.750 |

The individual layers also contained W-1 to W-6, B-4 to B-6, F-1 to F-17, as well as a lead salt, a platinum salt, an iridium salt and a rhodium salt as appropriate in order to provide better keeping quality, processability, pressure resistance, mildew-proof and sterile properties, anti-static property and applicability.

Samples 202–207 were prepared by repeating the procedure for the preparation of sample 201, except that infrared couplers (1), (4), (10), (26), (35) and (40) were added to the 8th layer in a molar amount equal to that of ExM-2 in the 8th layer.

Sample 201 was a comparative sample; it was a color light-sensitive material using a cyan sensitive layer as the fourth light-sensitive layer (8th layer); in addition, it used a magenta color forming DIR with a view to imparting interimage effects to the red-sensitive layers (RL).

Samples 202–207 were color light-sensitive materials of the invention; they also used a magenta color forming DIR in the cyan sensitive layer as the fourth light-sensitive layer (8th layer) with a view to imparting interimage effects to the red-sensitive layers (RL); in addition, they used various infrared color forming couplers.

Samples 201–207 were exposed and developed in the same manner as with sample 101, except that the amount of exposure was varied at 5 levels, −1, N (correct exposure), +1, +2 and +3.

Sample 201 was read with a 3-channel scanner as in the case of sample 102 to pick up image information for the three colors (R,G,B) and samples 202–207 were read with a 4-channel scanner as in the case of sample 101 to pick up image information for the four colors (R,G,B,IR); the incorporated information was subjected to image processing for preparing photographic prints.

In order to determine the departure (color difference, ΔE) from the faithful color reproduction, a picture of a Macbeth chart was taken on each of samples 201–207 under a color evaluating fluorescent lamp (product of TOSHIBA CORP.), which were then subjected to image processing as described above to prepare photographic prints. The thus prepared photographic prints were compared with the Macbeth chart to calculate the color difference. In this way, samples 201–207 were compared for the fidelity in color reproduction at various levels of exposure; the results are shown in Table 7.

TABLE 7

| | Departure from faithful color reproduction (ΔE) | | | | |
|---|---|---|---|---|---|
| | −1 | N | +1 | +2 | +3 |
| Sample 201 (comparison) | 14 | 5 | 8 | 13 | 17 |
| Sample 202 (invention) | 5 | 4 | 5 | 5 | 6 |
| Sample 203 (invention) | 5 | 4 | 5 | 5 | 6 |
| Sample 204 (invention) | 5 | 4 | 5 | 5 | 6 |
| Sample 205 (invention) | 5 | 4 | 5 | 5 | 6 |
| Sample 206 (invention) | 5 | 4 | 5 | 5 | 6 |
| Sample 207 (invention) | 5 | 4 | 5 | 5 | 6 |

As is clear from Table 7, when the amount of exposure departed from the correct value (N) to either positive or negative side, samples 202–207 of the invention achieved far more faithful color reproduction than comparative sample 201.

Near at the correct exposure (N), samples 202–207 were comparable to comparative sample 201 in the fidelity of color reproduction but they had a meritorious advantage in that the dependency of fidelity on the amount of exposure was extremely smaller than that of comparative sample 201.

It is therefore clear that the design of the invention achieves a marked improvement in the fidelity of color reproduction.

While the color light-sensitive material according to the first aspect of the invention, as well as the image processing method and apparatus according to the second and third aspects which use this color light-sensitive material have been described above in detail with reference to various examples and embodiments, it should be understood that the invention is by no means limited to those particular examples and embodiments and that various improvements and modifications can be made without departing from the spirit and scope of the invention.

As described in detail on the foregoing pages, the color light-sensitive material according to the first aspect of the invention allows the fourth and additional light-sensitive layers to exhibit their performance to the fullest extent without suffering the constraint of chemical reactions and makes it possible to achieve a color reproduction which is sufficiently improved by increasing the precision in color reproduction without being limited by the potentials of the light-sensitive material used.

As another advantage, it is not essential for the color light-sensitive material of the invention to allow the fourth and any additional light-sensitive layers to contain the DIR compound, colored coupler, etc. which produce interimage effects on other layers by chemical reactions mediated with the developer, so the color light-sensitive material of the invention is also applicable as color light-sensitive materials that can be developed without using liquid developers and those color light-sensitive materials which are inherently incapable of providing interimage effects, as exemplified by thermally developable color light-sensitive materials.

If the color light-sensitive material of the invention is of such a type that color materials in the fourth light-sensitive layer such as a cyan sensitive layer and additional light-sensitive layers have peak wavelengths of spectral absorption in the infrared or ultraviolet region, it can reproduce images with better color reproduction on the basis of four kinds of image information as read by image input means such as a 4-channel scanner in the image processing apparatus according to the third aspect of the invention. The stated type of color light-sensitive material of the invention can also be used as such with a conventional scanner having only three RGB light-sensitive portions or a digital photoprinter fitted with this scanner; it can also be used with a conventional analog photoprinter which performs planar exposure.

In particular, if the color light-sensitive material of the invention is of such a type that it has the fourth and additional light-sensitive layers containing not only color materials that form colors in the infrared or ultraviolet region but also DIR compounds or colored couplers that exhibit interimage effects on other layers and if it is designed to be developed by a conventional liquid developer, it will be much more suitable not only for digital scan exposure but also analog exposure including planar exposure and slit scan exposure.

The image processing method according to the second aspect of the invention and the image processing apparatus according to the third aspect of the invention have the advantage that using the color light-sensitive material having the above-described outstanding characteristics, they can output reproduced images with markedly improved color reproduction.

What is claimed is:

1. A color light-sensitive material having at least four light-sensitive layers of different spectral sensitivity waveforms in a visible range, with a covariance between spectral sensitivities of said at least four light-sensitive layers being no more than 0.5, and said at least four light-sensitive layers, after development processing, being colored with color materials having different spectral absorption waveforms.

2. The color light-sensitive material according to claim 1, wherein the spectral absorption waveforms of said color materials have peak wavelengths that differ from one another by at least 20 nm.

3. The color light-sensitive material according to claim 1, wherein at least one of said color materials has a spectral absorption maximum at a wavelength longer than 720 nm or shorter than 430 nm.

4. The color light-sensitive material according to claim 1, wherein said at least four light-sensitive layers include a cyan sensitive layer.

5. The color light-sensitive material according to claim 4, wherein said cyan sensitive layer has a spectral sensitivity peak in a wavelength range of 470 nm–550 nm.

6. The color light-sensitive material according to claim 1, wherein said at least four light-sensitive layers include a red-sensitive layer, a green-sensitive layer and a blue-sensitive layer.

7. An image processing method comprising steps of:

exposing and developing a color light-sensitive material to form an image, said color light-sensitive material having at least four light-sensitive layers of different spectral sensitivity waveforms in a visible range, with a covariance between spectral sensitivities of said at least four light-sensitive layers being no more than 0.5, and said at least four light-sensitive layers, after development processing, being colored with color materials having different spectral absorption waveforms;

allowing the image formed on said color light-sensitive material to be entered by an image input device having at least four light-sensitive portions of different spectral sensitivity waveforms; and performing color transformation on an input image obtained by entering.

8. The image processing method according to claim 7, wherein said color transformation is performed on a basis of spectral sensitivity waveforms of said color light-sensitive material.

9. The image processing method according to claim 7, wherein the spectral absorption waveforms of said color materials have peak wavelengths that differ from one another by at least 20 nm.

10. The image processing method according to claim 7, wherein at least one of said color materials has a spectral absorption maximum at a wavelength longer than 720 nm or shorter than 430 nm.

11. The image processing method according to claim 7, wherein said at least four light-sensitive layers include a cyan sensitive layer.

12. The image processing method according to claim 11, wherein said cyan sensitive layer has a spectral sensitivity peak in a wavelength range of 470 nm–550 nm.

13. The image processing method according to claim 7, wherein said at least four light-sensitive layers include a red-sensitive layer, a green-sensitive layer and a blue-sensitive layer.

* * * * *